US010837238B2

(12) United States Patent
Gupta et al.

(10) Patent No.: US 10,837,238 B2
(45) Date of Patent: Nov. 17, 2020

(54) SIDE SADDLE SLINGSHOT CONTINUOUS MOTION RIG

(71) Applicant: Nabors Drilling Technologies USA, Inc., Houston, TX (US)

(72) Inventors: Ashish Gupta, Houston, TX (US); Padira Reddy, Richmond, TX (US); Denver Lee, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/514,302

(22) Filed: Jul. 17, 2019

(65) Prior Publication Data

US 2020/0024907 A1 Jan. 23, 2020

Related U.S. Application Data

(60) Provisional application No. 62/700,704, filed on Jul. 19, 2018.

(51) Int. Cl.

| | |
|---|---|
| ***E21B 15/00*** | (2006.01) |
| *E21B 19/16* | (2006.01) |
| *E04H 12/34* | (2006.01) |

(52) U.S. Cl.

CPC ..... *E21B 15/003* (2013.01); *E04H 12/34* (2013.01); *E21B 19/164* (2013.01)

(58) Field of Classification Search

CPC .... E21B 15/003; E21B 19/164; E21B 19/155; E21B 19/14; E21B 4/16; E21B 7/02; E21B 7/04; E21B 15/045; E21B 15/04; E21B 21/00; E21B 19/00; E04H 12/34

USPC ..... 52/111, 114, 116, 117, 118, 632, 651.05

See application file for complete search history.

(56) References Cited

U.S. PATENT DOCUMENTS

| | | | |
|---|---|---|---|
| 1,733,484 | A | 10/1929 | Davis |
| 2,332,479 | A | 10/1943 | Woolslayer et al. |
| 2,345,253 | A | 3/1944 | Funk |
| 2,347,115 | A | 4/1944 | Lewis |
| 2,594,847 | A | 4/1952 | Bates et al. |

(Continued)

FOREIGN PATENT DOCUMENTS

| | | | |
|---|---|---|---|
| BR | 9811431 | A | 9/1998 |
| CA | 2755483 | A1 | 11/2010 |

(Continued)

OTHER PUBLICATIONS

Office Action issued in Colombian App. No. NC2018/0012922 and English translation thereof, dated Apr. 1, 2020 (14 pages).

(Continued)

*Primary Examiner* — Joshua K Ihezie

(74) *Attorney, Agent, or Firm* — Adolph Locklar

(57) ABSTRACT

A drilling rig includes a rig floor, first and second support structures, a mast, a lower drilling machine, a continuous drilling unit, an upper drilling machine, and an upper mast assembly. The rig floor includes a V-door defining a V-door axis extending perpendicularly from the side of the rig floor that includes the V-door. The first and second support structures define a traverse corridor having a traverse corridor axis, wherein the traverse corridor axis is perpendicular to the V-door axis. The drilling rig may be used for continuous drilling of a wellbore.

26 Claims, 34 Drawing Sheets

(56) References Cited

U.S. PATENT DOCUMENTS 2,792,198 A * 5/1957 Braun ..... E21B 15/04 175/5
3,028,881 A 4/1962 Koomey et al.
3,228,151 A 1/1966 Woolslayer et al.
3,255,836 A 6/1966 Hoppmann et al.
3,433,268 A 3/1969 Greer
3,483,933 A 12/1969 Dyer et al.
3,576,225 A 4/1971 Chambers
3,598,189 A * 8/1971 Presley ..... E21B 7/00 175/53
3,650,339 A 3/1972 Selfe et al.
3,676,984 A 7/1972 Clark
3,716,149 A 2/1973 Scaggs
3,739,853 A 6/1973 Wales
3,754,361 A 8/1973 Branham et al.
3,802,137 A 4/1974 Armstrong
3,851,770 A 12/1974 Jenkins et al.
3,922,825 A 12/1975 Eddy et al.
3,937,334 A 2/1976 Bleyl et al.
3,942,593 A 3/1976 Reeve, Jr. et al.
3,991,887 A 11/1976 Trout
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,375,892 A 3/1983 Jenkins et al.
4,403,898 A 9/1983 Thompson
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A 7/1988 Reed
4,759,414 A * 7/1988 Willis ..... E21B 15/00 173/185
4,821,816 A 4/1989 Willis
4,823,870 A 4/1989 Sorokan
4,834,604 A 5/1989 Brittain et al.
4,837,992 A 6/1989 Hashimoto
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A 2/1996 Suksumake
5,921,336 A 7/1999 Reed
6,026,912 A * 2/2000 King ..... E21B 3/02 175/27
6,161,358 A 12/2000 Mochizuki et al.
6,343,892 B1 2/2002 Kristiansen
6,491,477 B2 12/2002 Bennett, Jr. et al.
6,581,525 B2 6/2003 Smith
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,249,629 B2 7/2007 Cunningham et al.
7,255,180 B2 8/2007 Beato et al.
7,306,055 B2 * 12/2007 Barnes ..... E21B 7/02 175/122
7,308,953 B2 * 12/2007 Barnes ..... E21B 7/02 175/122
7,357,616 B2 4/2008 Andrews et al.
7,401,656 B2 7/2008 Wood et al.
7,404,697 B2 7/2008 Thompson
7,584,809 B1 * 9/2009 Flud ..... E21B 7/02 175/162
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 * 6/2011 Wright ..... E21B 19/155 166/377
7,992,646 B2 8/2011 Wright et al.
8,051,930 B1 11/2011 Barnes et al.
8,181,698 B2 5/2012 Springett et al.
8,250,816 B2 8/2012 Donnally et al.
8,297,362 B1 10/2012 Strider et al.
8,316,588 B2 11/2012 Cicognani
8,468,753 B2 6/2013 Donnally et al.
8,474,216 B1 7/2013 Goerner
8,490,724 B2 7/2013 Smith et al.
8,516,751 B2 8/2013 Konduc et al.
8,549,815 B2 10/2013 Donnally et al.
8,555,564 B2 10/2013 Wasterval
8,561,685 B2 10/2013 Rodgers
8,651,200 B2 2/2014 Krohn et al.
8,661,743 B2 3/2014 Flusche
8,720,128 B2 5/2014 Vogt
8,726,984 B2 5/2014 Krohn et al.
8,794,351 B2 8/2014 Krohn et al.
8,813,436 B2 8/2014 Donnally et al.
8,844,616 B2 9/2014 Krohn et al.
8,863,449 B2 10/2014 Donnally et al.
8,904,716 B2 * 12/2014 Donnally ..... E21B 15/00 52/117
8,936,424 B1 1/2015 Barnes
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 5/2015 Trevithick et al.
9,091,125 B2 7/2015 Konduc et al.
9,091,126 B2 * 7/2015 Thiessen ..... E21B 15/00
9,091,128 B1 7/2015 Orgeron et al.
9,096,282 B2 8/2015 Smith et al.
9,132,871 B2 9/2015 Crisp et al.
9,140,080 B2 9/2015 Flusche
9,151,412 B2 10/2015 Trevithick et al.
9,157,286 B2 10/2015 Richardson et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,334,668 B2 5/2016 Wijning et al.
9,353,601 B2 5/2016 Hause
9,382,766 B2 7/2016 Flusche
9,399,890 B2 * 7/2016 Mark ..... E21B 19/155
9,441,423 B2 9/2016 Donnally et al.
9,366,053 B2 10/2016 Thiessen et al.
9,464,488 B2 10/2016 Thiessen
9,476,267 B2 10/2016 Orgeron et al.
9,488,014 B2 11/2016 Sparkman et al.
9,518,429 B2 12/2016 Fortson et al.
9,533,723 B2 1/2017 Smith et al.
9,562,407 B2 2/2017 Magnuson
9,574,402 B2 2/2017 Hause
9,580,122 B2 2/2017 Doherty
9,624,734 B2 4/2017 Davis et al.
9,631,443 B2 4/2017 Folk
9,650,840 B2 5/2017 Cheng et al.
9,677,298 B2 6/2017 Konduc et al.

(56) References Cited

U.S. PATENT DOCUMENTS

| | | | | |
|---|---|---|---|---|
| 9,708,854 | B2 | 7/2017 | Krohn et al. | |
| 9,708,861 | B2 * | 7/2017 | Reddy | E21B 15/003 |
| 9,725,955 | B2 | 8/2017 | Skjaerseth et al. | |
| 9,739,098 | B2 | 8/2017 | Fox | |
| 9,777,544 | B2 | 10/2017 | Skjaerseth et al. | |
| 9,784,040 | B2 | 10/2017 | Smith et al. | |
| 9,790,751 | B2 | 10/2017 | Reddy et al. | |
| 9,797,196 | B2 | 10/2017 | Taggart et al. | |
| 9,810,027 | B2 | 11/2017 | Reddy et al. | |
| 9,822,593 | B2 | 11/2017 | Eilertsen et al. | |
| 9,845,813 | B2 | 12/2017 | Shimizu et al. | |
| 9,879,442 | B2 | 1/2018 | Magnuson et al. | |
| 9,926,719 | B2 | 3/2018 | Reddy et al. | |
| 9,951,539 | B2 | 4/2018 | Roodenburg et al. | |
| 10,094,137 | B2 | 10/2018 | Reddy et al. | |
| 10,094,176 | B2 | 10/2018 | Reddy et al. | |
| 10,144,463 | B2 | 12/2018 | Flusche et al. | |
| 10,214,936 | B2 * | 2/2019 | Reddy | E04H 12/345 |
| 10,214,937 | B2 | 2/2019 | Reddy et al. | |
| 10,214,970 | B1 | 2/2019 | Gupta et al. | |
| 10,221,631 | B2 | 3/2019 | Reddy et al. | |
| 10,273,708 | B2 | 4/2019 | Holst et al. | |
| 10,280,692 | B2 | 5/2019 | Reddy et al. | |
| 10,358,877 | B1 | 7/2019 | Gupta et al. | |
| 10,407,938 | B2 | 10/2019 | Reddy et al. | |
| 10,428,592 | B2 | 10/2019 | Gupta et al. | |
| 10,487,592 | B1 * | 11/2019 | Gupta | E21B 21/065 |
| 2001/0025727 | A1 | 10/2001 | Byrt et al. | |
| 2002/0001255 | A1 | 1/2002 | Flood et al. | |
| 2003/0172599 | A1 * | 9/2003 | Frink | E21B 15/003 52/116 |
| 2004/0211598 | A1 | 10/2004 | Palidis | |
| 2006/0231267 | A1 | 10/2006 | Wood | |
| 2008/0237170 | A1 | 10/2008 | Altman et al. | |
| 2009/0000218 | A1 * | 1/2009 | Lee | E21B 15/00 52/123.1 |
| 2009/0025980 | A1 | 1/2009 | Callander et al. | |
| 2009/0053013 | A1 | 2/2009 | Maltby | |
| 2009/0200856 | A1 | 8/2009 | Chehade et al. | |
| 2009/0218144 | A1 | 9/2009 | Donnally et al. | |
| 2009/0272540 | A1 | 11/2009 | Rodgers | |
| 2010/0032213 | A1 * | 2/2010 | Orgeron | E21B 19/155 175/85 |
| 2010/0038088 | A1 * | 2/2010 | Springett | E21B 15/003 166/313 |
| 2010/0147524 | A1 * | 6/2010 | Springett | E21B 15/003 166/313 |
| 2010/0186960 | A1 * | 7/2010 | Reitsma | E21B 21/106 166/305.1 |
| 2010/0329823 | A1 | 12/2010 | Baumier et al. | |
| 2011/0030942 | A1 | 2/2011 | Orgeron | |
| 2011/0072737 | A1 | 3/2011 | Wasterval | |
| 2011/0174545 | A1 | 7/2011 | Hartke et al. | |
| 2011/0247290 | A1 * | 10/2011 | Beck | E21B 15/02 52/651.05 |
| 2011/0280104 | A1 * | 11/2011 | McClung, III | E21B 3/02 367/82 |
| 2012/0168179 | A1 | 7/2012 | Having et al. | |
| 2012/0304553 | A1 | 12/2012 | Konduc et al. | |
| 2013/0153309 | A1 | 6/2013 | Smith et al. | |
| 2013/0305632 | A1 | 11/2013 | Rivera, Sr. et al. | |
| 2014/0014417 | A1 | 1/2014 | Smith et al. | |
| 2014/0044510 | A1 | 2/2014 | Eldib et al. | |
| 2014/0054097 | A1 | 2/2014 | Bryant | |
| 2014/0224543 | A1 * | 8/2014 | Padira | E21B 33/06 175/85 |
| 2014/0298735 | A1 * | 10/2014 | Vogt | E21B 7/023 52/118 |
| 2015/0008039 | A1 * | 1/2015 | Wijning | E21B 15/00 175/52 |
| 2015/0143759 | A1 * | 5/2015 | Sparkman | E21B 15/00 52/123.1 |
| 2015/0218891 | A1 | 8/2015 | Reddy et al. | |
| 2015/0284950 | A1 * | 10/2015 | Stramandinoli | E04B 2/90 52/235 |
| 2015/0315861 | A1 | 11/2015 | Zachariasen et al. | |
| 2016/0002946 | A1 * | 1/2016 | Wijning | E04B 1/19 52/116 |
| 2016/0130877 | A1 * | 5/2016 | Fortson | E21B 7/023 52/121 |
| 2016/0186495 | A1 | 6/2016 | Flusche | |
| 2016/0215592 | A1 * | 7/2016 | Helms | E21B 41/00 |
| 2016/0258215 | A1 | 9/2016 | Holst | |
| 2016/0258225 | A1 | 9/2016 | Holst | |
| 2016/0280524 | A1 | 9/2016 | Crisp et al. | |
| 2016/0298394 | A1 * | 10/2016 | Padira | E04H 12/345 |
| 2016/0312543 | A1 * | 10/2016 | Cheng | E21B 15/00 |
| 2017/0096832 | A1 | 4/2017 | Robb | |
| 2017/0106925 | A1 | 4/2017 | Gupta et al. | |
| 2017/0241126 | A1 | 8/2017 | Konduc et al. | |
| 2017/0328081 | A1 | 11/2017 | Trevithick | |
| 2018/0016851 | A1 * | 1/2018 | Reddy | E21B 15/003 |
| 2018/0030788 | A1 | 2/2018 | Reddy et al. | |
| 2018/0128056 | A1 * | 5/2018 | Gupta | E21B 15/00 |
| 2018/0238125 | A1 | 8/2018 | Skjaerseth et al. | |
| 2018/0245410 | A1 | 8/2018 | Skjaerseth et al. | |
| 2019/0003256 | A1 | 1/2019 | Skjaerseth et al. | |
| 2019/0003269 | A1 | 1/2019 | Skjaerseth et al. | |
| 2019/0145122 | A1 | 5/2019 | Reddy et al. | |
| 2019/0203495 | A1 | 7/2019 | Reddy et al. | |

FOREIGN PATENT DOCUMENTS

| | | | |
|---|---|---|---|
| CA | 2753417 | A1 | 2/2011 |
| CN | 201254949 | A | 9/2008 |
| CN | 101358510 | A | 2/2009 |
| CN | 201778661 | U | 3/2011 |
| CO | 092263646 | A | 5/1989 |
| CO | 04042280 | A | 6/2004 |
| CO | 05118908 | A | 4/2006 |
| CO | 07097892 | A | 4/2008 |
| DE | 849533 | C | 9/1952 |
| EP | 2751370 | B1 | 7/2014 |
| EP | 3022381 | A | 1/2015 |
| EP | 3081737 | T | 11/2016 |
| EP | 3587728 | T | 1/2020 |
| FR | 2556042 | A1 | 6/1985 |
| KR | 101402500 | A | 2/2013 |
| WO | 9943920 | A1 | 9/1999 |
| WO | WO2009106859 | A | 9/2009 |
| WO | WO2012092147 | A | 6/2013 |
| WO | 2016025521 | A2 | 2/2016 |
| WO | 2016048458 | A1 | 3/2016 |
| WO | 2016199088 | A1 | 12/2016 |
| WO | 2016199102 | A1 | 12/2016 |
| WO | 2016199103 | A1 | 12/2016 |
| WO | 2017043976 | A1 | 3/2017 |

OTHER PUBLICATIONS

NABORS 990 PROYECTO LLANOS.WMV; https://www.youtube.com/watch?v=6BgfgWumRIU, NABORS RIG 990 Chichimene, Colombia; Youtube.com; Aug. 10, 2011 (231 pages).

Drilling Contractor; "Nabors modular Rig 702 in Papua New Guinea-bound for Exxon Mobil"; Drilling Contractor, in Drilling Rigs & Automation, News, Jul. 6, 2011; 2 pages; www.drillingcontractor.org.

Drilling Contractor; "Nabors to base all future land rigs on Minimum Area AC rig concept"; Drilling Contractor, in News, Aug. 22, 2011; 2 pages; www.drillingcontractor.org.

Sebastion, Simone; "Big drill soon begins long commute to work"; Houston Chronicle, Sunday, Jul. 3, 2011; 3 pages; www.chron.com.

Gaddy, Dean E., "Critical path analysis improves rig-moving procedures", Oil & Gas Journal, Nov. 16, 1998 (5 pages).

* cited by examiner

SIDE SADDLE SLINGSHOT CONTINUOUS MOTION RIG

CROSS-REFERENCE TO RELATED APPLICATIONS

This application is a non-provisional application which claims priority from U.S. provisional application No. 62/700,704, filed Jul. 19, 2018, the entirety of which is hereby incorporated by reference.

TECHNICAL FIELD/FIELD OF THE DISCLOSURE

The present disclosure relates generally to drilling rigs, and specifically to rig structures for drilling in the petroleum exploration and production industry.

BACKGROUND OF THE DISCLOSURE

Land-based drilling rigs may be configured to be moved to different locations to drill multiple wells within the same area, traditionally known as a wellsite. In certain situations, the land-based drilling rigs may travel across an already-drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing wellheads, and may also interfere with raising and lowering of equipment needed for operations.

SUMMARY

The present disclosure provides for a drilling rig. The drilling rig may include a rig floor having a V-door. The side of the rig floor including the V-door may define a V-door side of the rig floor. The V-door may have a V-door axis defined as perpendicular to the V-door side of the rig floor. The drilling rig may include a first support structure and a second support structure. The rig floor may be supported by the first and second support structures. The rig floor, first support structure, and second support structure may form a trabeated structure. An open space between the first and second support structures and below the rig floor may define a traverse corridor having a traverse corridor axis. The traverse corridor axis may be perpendicular to the V-door axis. The drilling rig may include a mast mechanically coupled to one or more of the rig floor, the first support structure, or the second support structure at one or more mast mounting points. The mast may include a frame having an open side defining a mast V-door side aligned with the V-door. The mast may include one or more racks coupled to the frame at the V-door side. The drilling rig may include a lower drilling machine (LDM) coupled to and moveable vertically relative to the mast. The drilling rig may include a continuous drilling unit (CDU) mechanically coupled to the LDM. The drilling rig may include an upper drilling machine (UDM) coupled to and moveable vertically relative to the mast. The drilling rig may include an upper mud assembly (UMA) coupled to and moveable vertically relative to the mast. The UMA may include a drilling mud supply pipe adapted to supply drilling fluid to a tubular member gripped by the UDM defining an upper flow path.

The present disclosure also provides for a method. The method may include positioning a drilling rig at a wellsite. The drilling rig may include a rig floor having a V-door. The side of the rig floor including the V-door may define a V-door side of the rig floor. The V-door may have a V-door axis defined as perpendicular to the V-door side of the rig floor. The drilling rig may include a first support structure and a second support structure. The rig floor may be supported by the first and second support structures. The rig floor, first support structure, and second support structure may form a trabeated structure. An open space between the first and second support structures and below the rig floor may define a traverse corridor having a traverse corridor axis. The traverse corridor axis may be perpendicular to the V-door axis. The drilling rig may include a mast mechanically coupled to one or more of the rig floor, the first support structure, or the second support structure at one or more mast mounting points. The mast may include a frame having an open side defining a mast V-door side aligned with the V-door. The mast may include one or more racks coupled to the frame at the V-door side. The drilling rig may include a lower drilling machine (LDM) coupled to and moveable vertically relative to the mast. The drilling rig may include a continuous drilling unit (CDU) mechanically coupled to the LDM. The drilling rig may include an upper drilling machine (UDM) coupled to and moveable vertically relative to the mast. The drilling rig may include an upper mud assembly (UMA) coupled to and moveable vertically relative to the mast. The UMA may include a drilling mud supply pipe adapted to supply drilling fluid to a tubular member gripped by the UDM defining an upper flow path. The method may also include continuously drilling a wellbore using the drilling rig.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
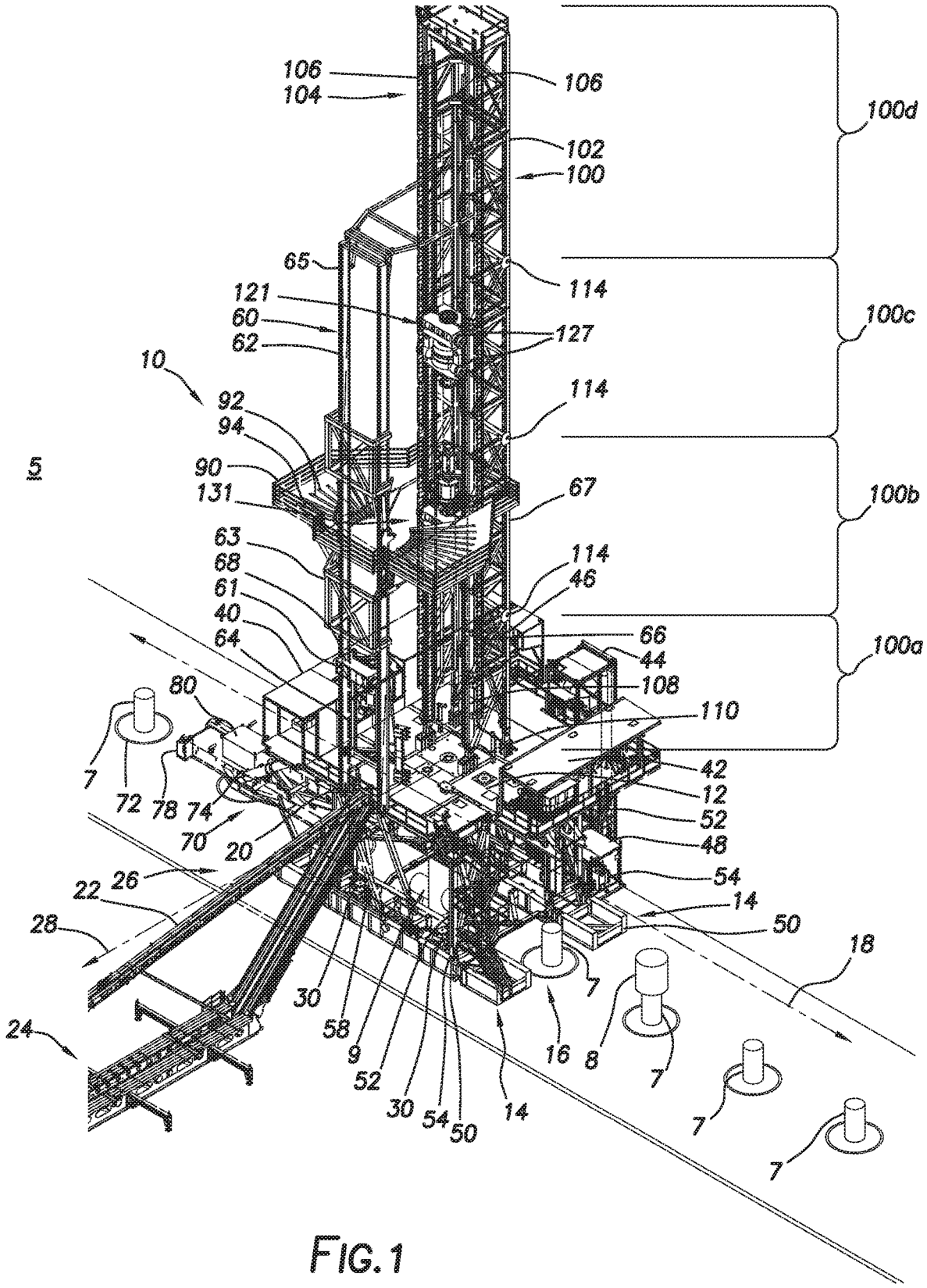
FIGS. 1-3 depict perspective views of a drilling rig consistent with at least one embodiment of the present disclosure.
Figure 2:
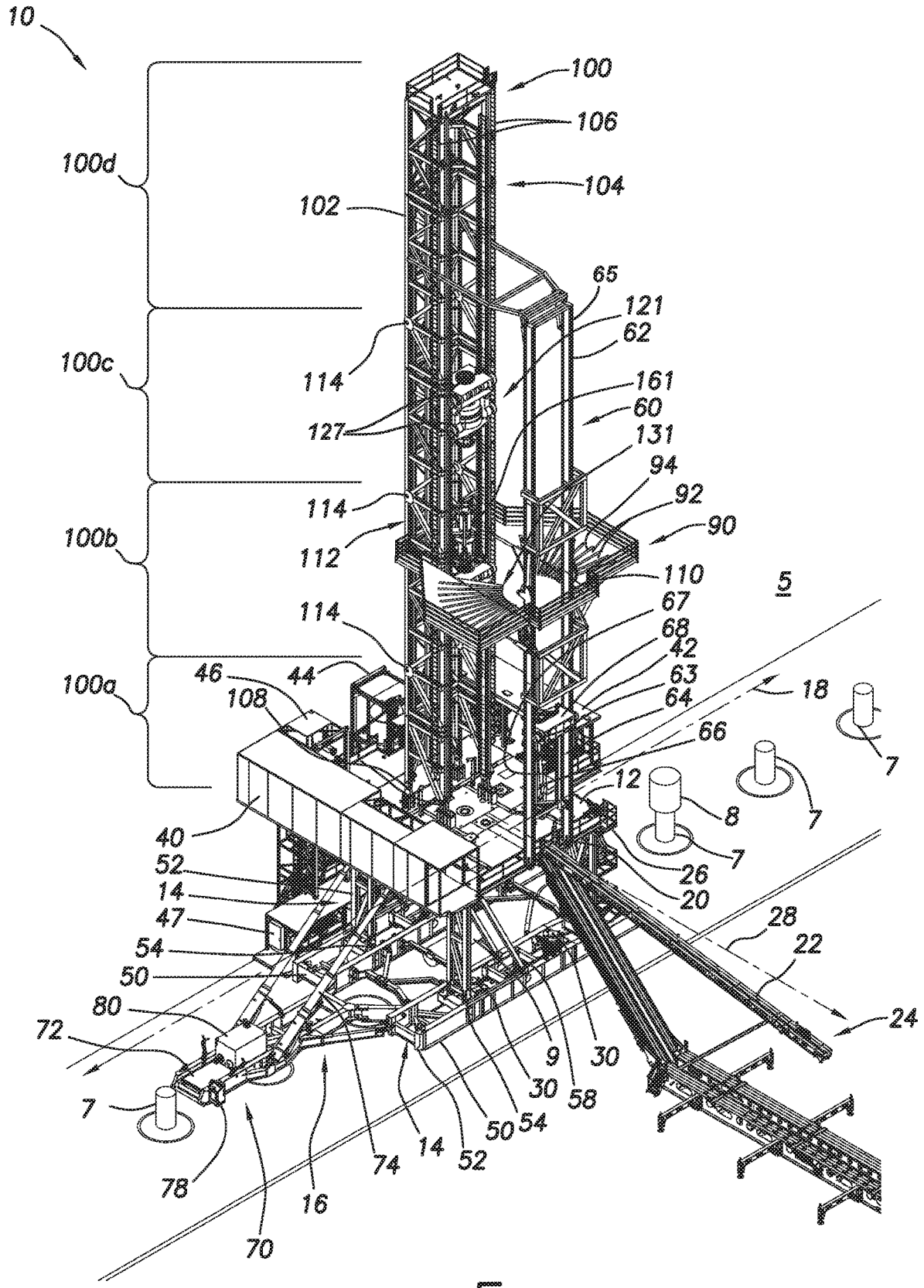
Figure 3:
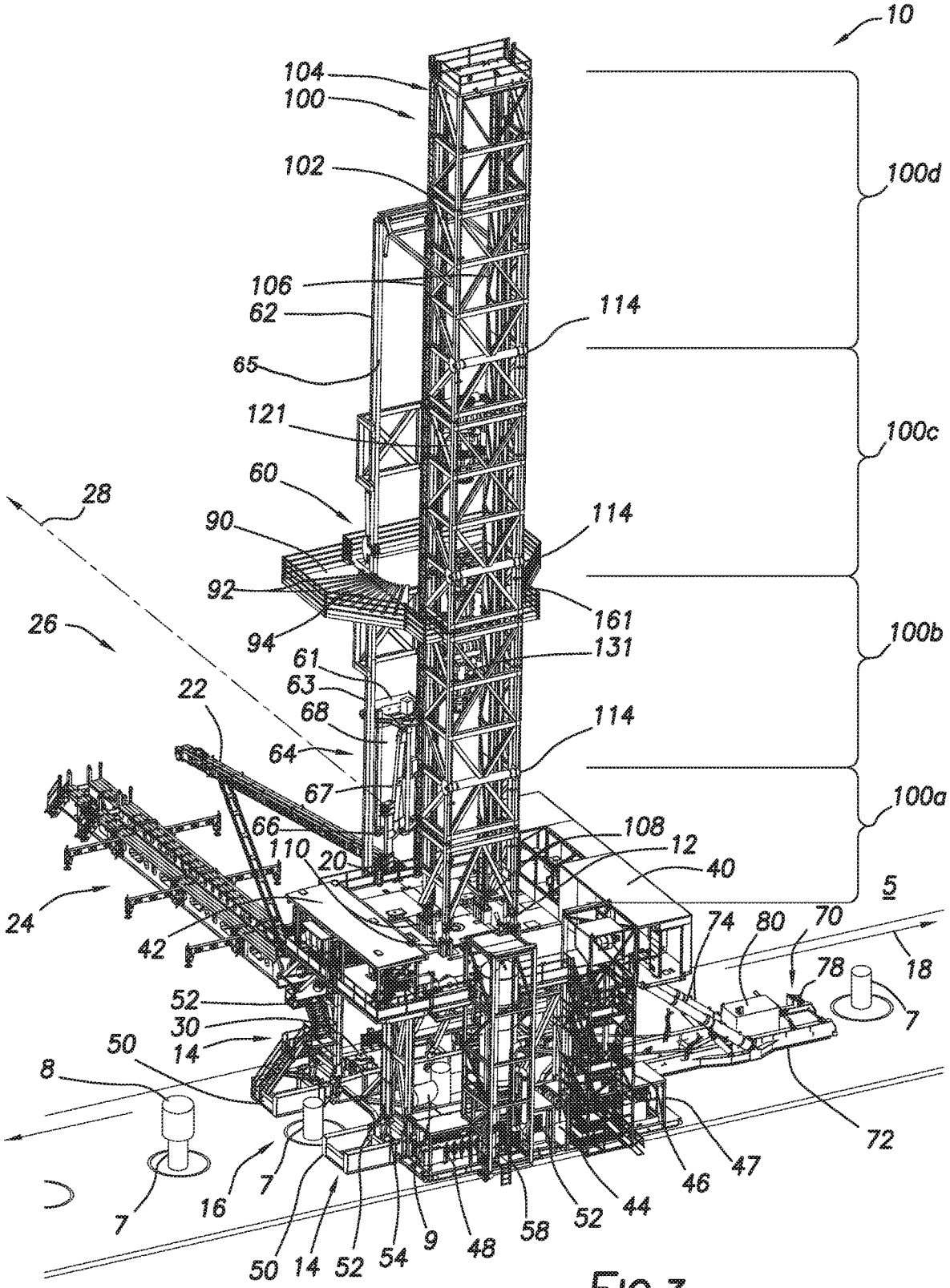
Figure 4:
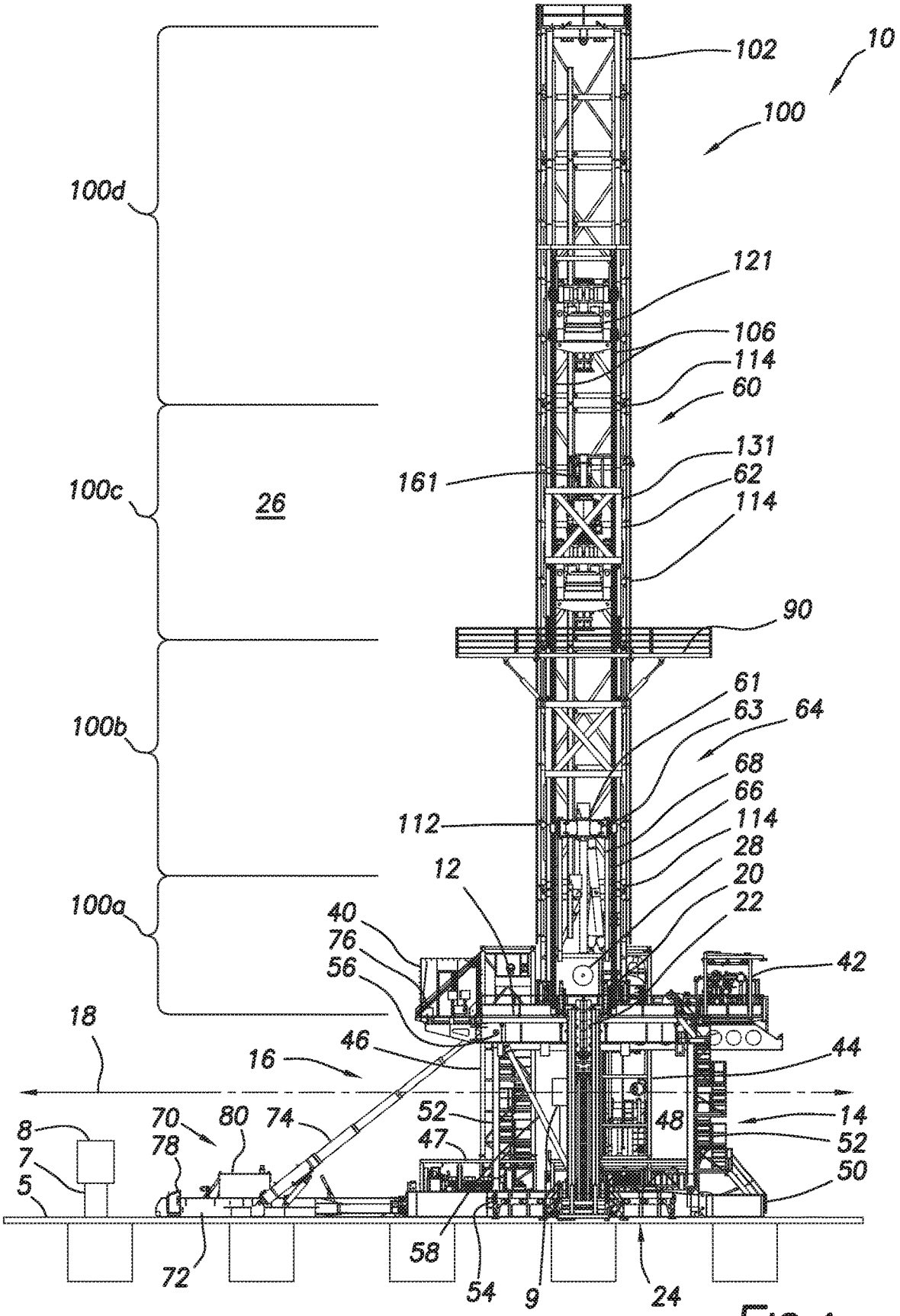
FIG. 4 depicts an elevation view of the V-door side of the drilling rig of FIGS. 1-3.
Figure 5:
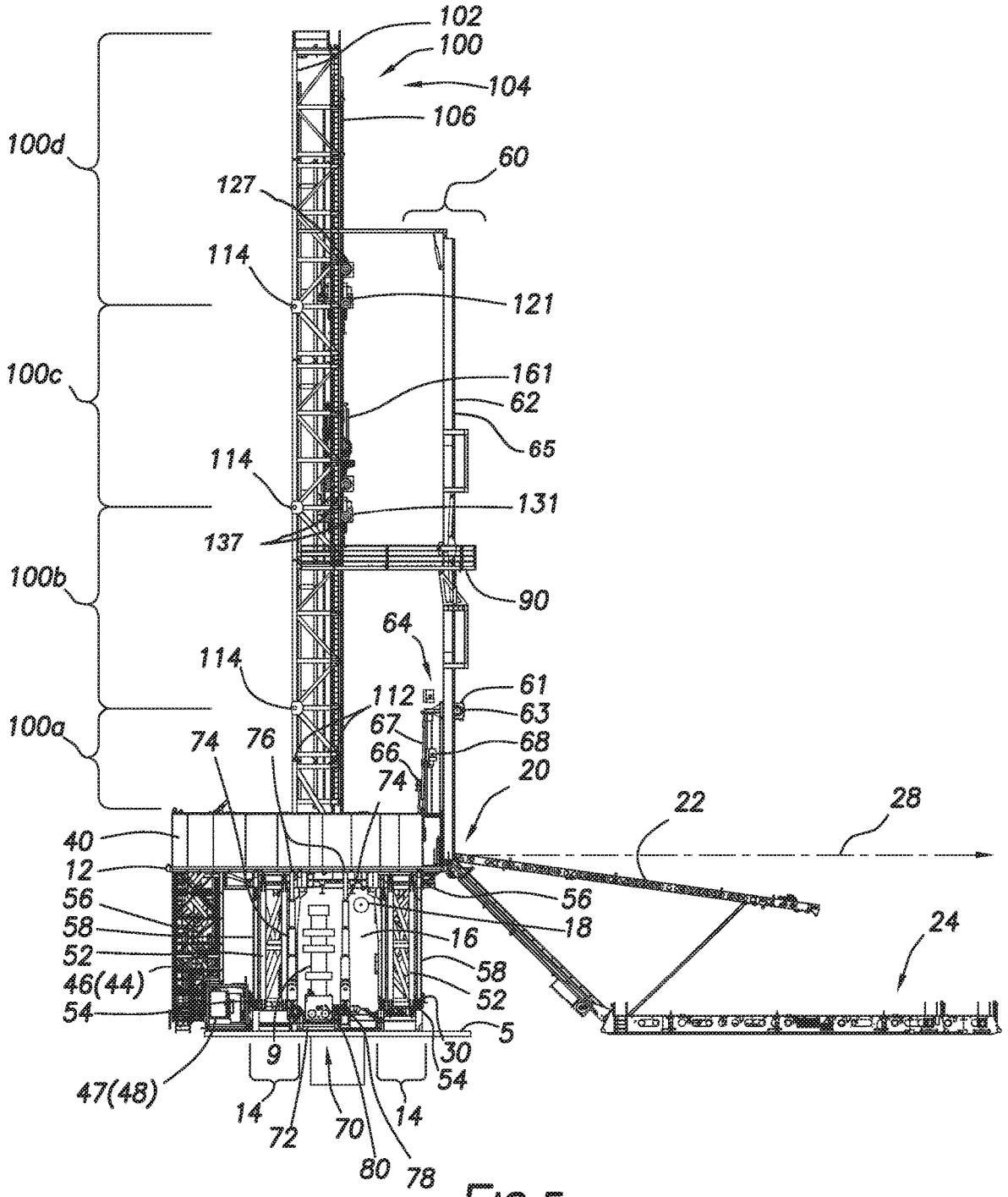
FIG. 5 depicts an elevation view of the driller's cabin side of the drilling rig of FIGS. 1-3.
Figure 6:
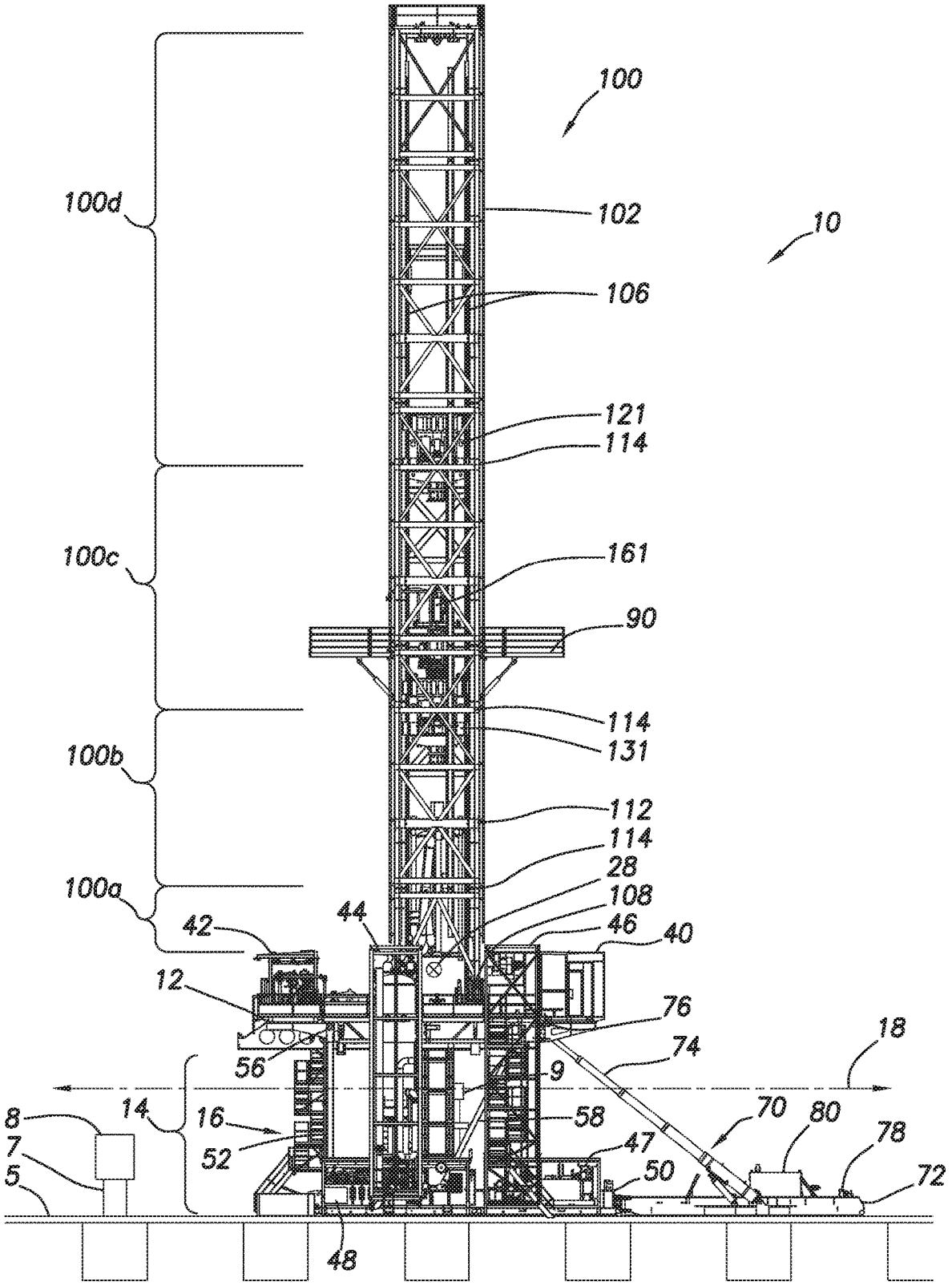
FIG. 6 depicts an elevation view of the back of the drilling rig of FIGS. 1-3.
Figure 7:
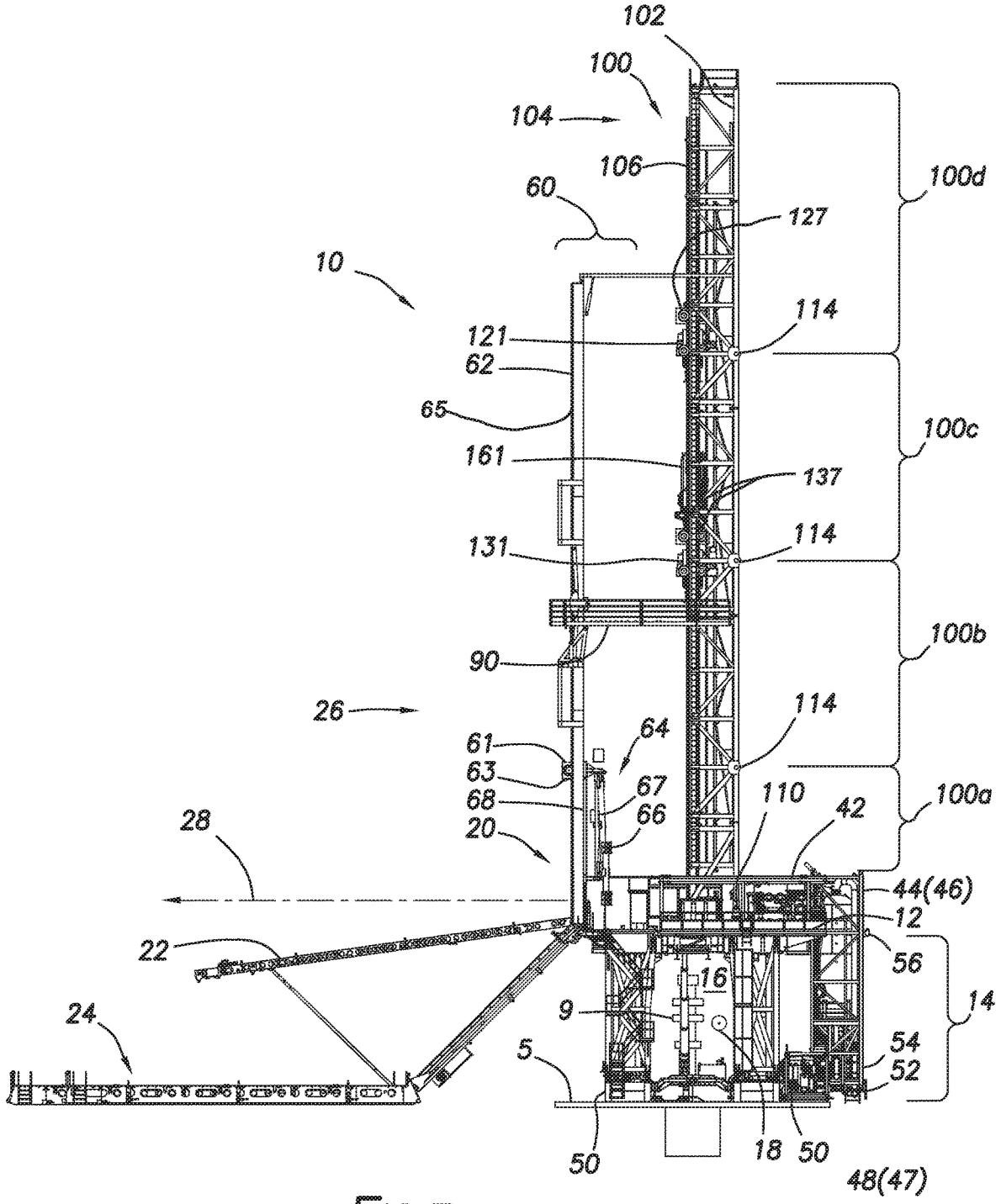
FIG. 7 depicts an elevation view of the off-driller's side of the drilling rig of FIGS. 1-3.
Figure 8:
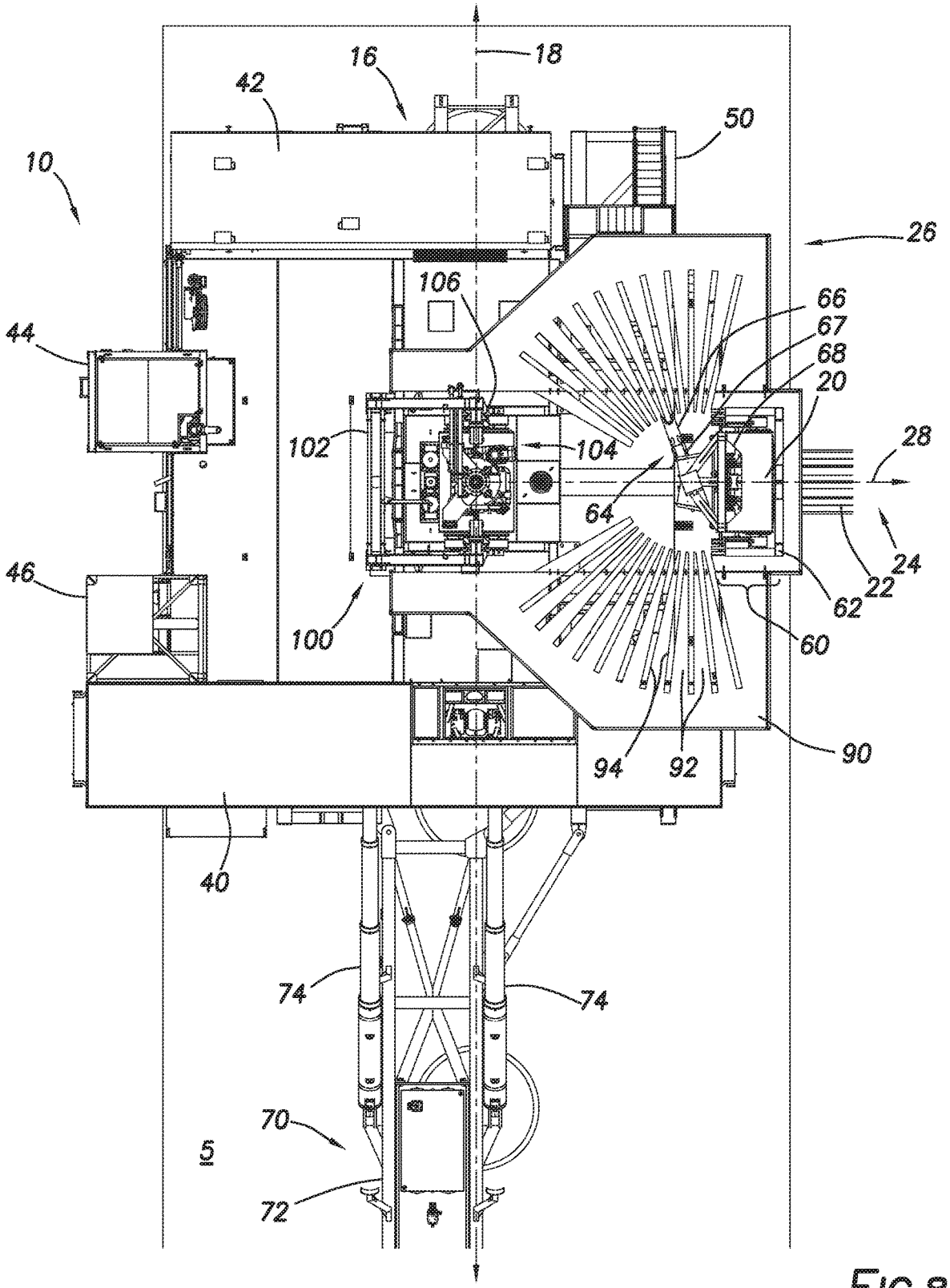
FIG. 8 depicts a top view of the drilling rig of FIGS. 1-3.
Figure 9:
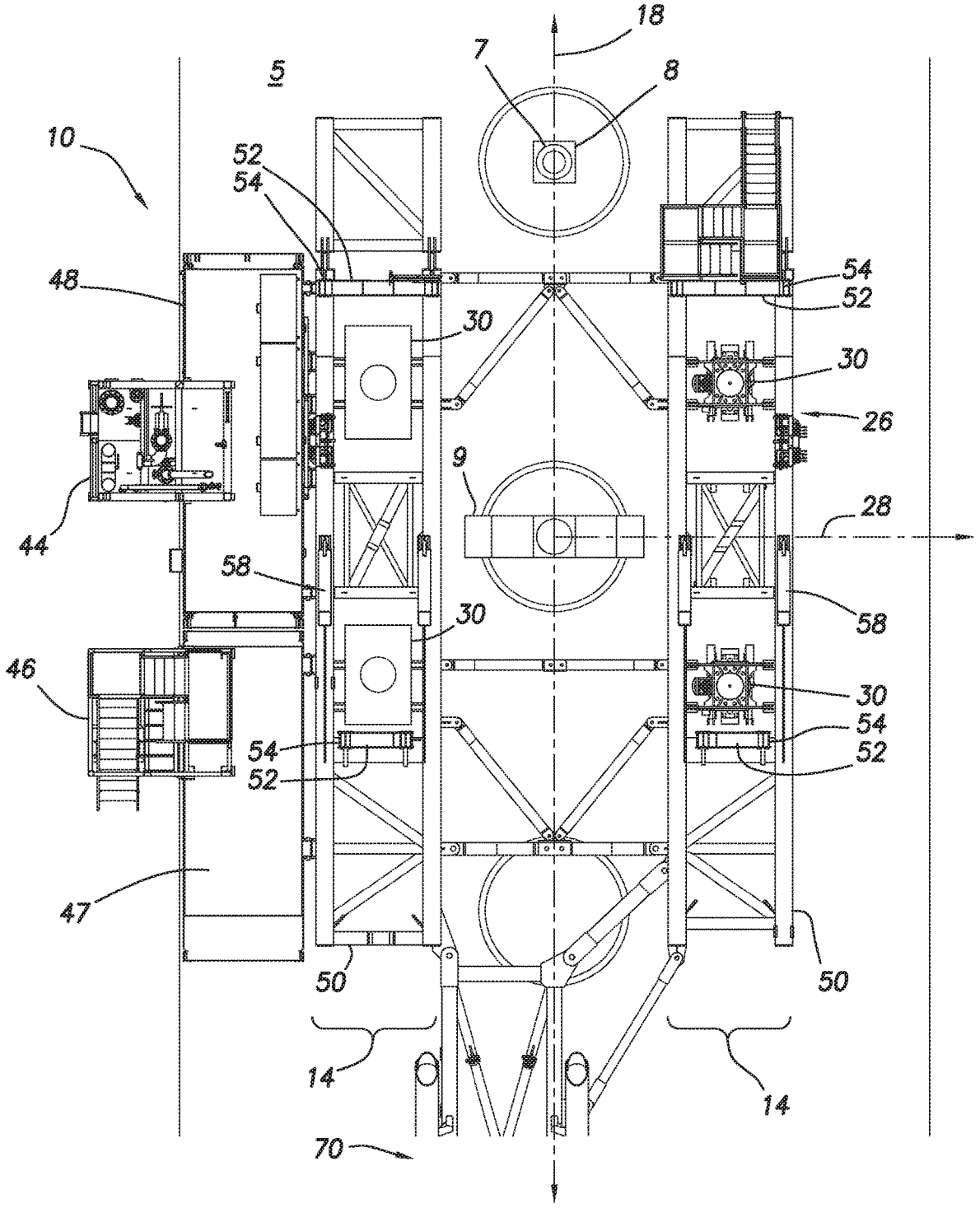
FIG. 9 depicts a cutaway top view of the support structures of the drilling rig of FIGS. 1-3.
Figure 10:
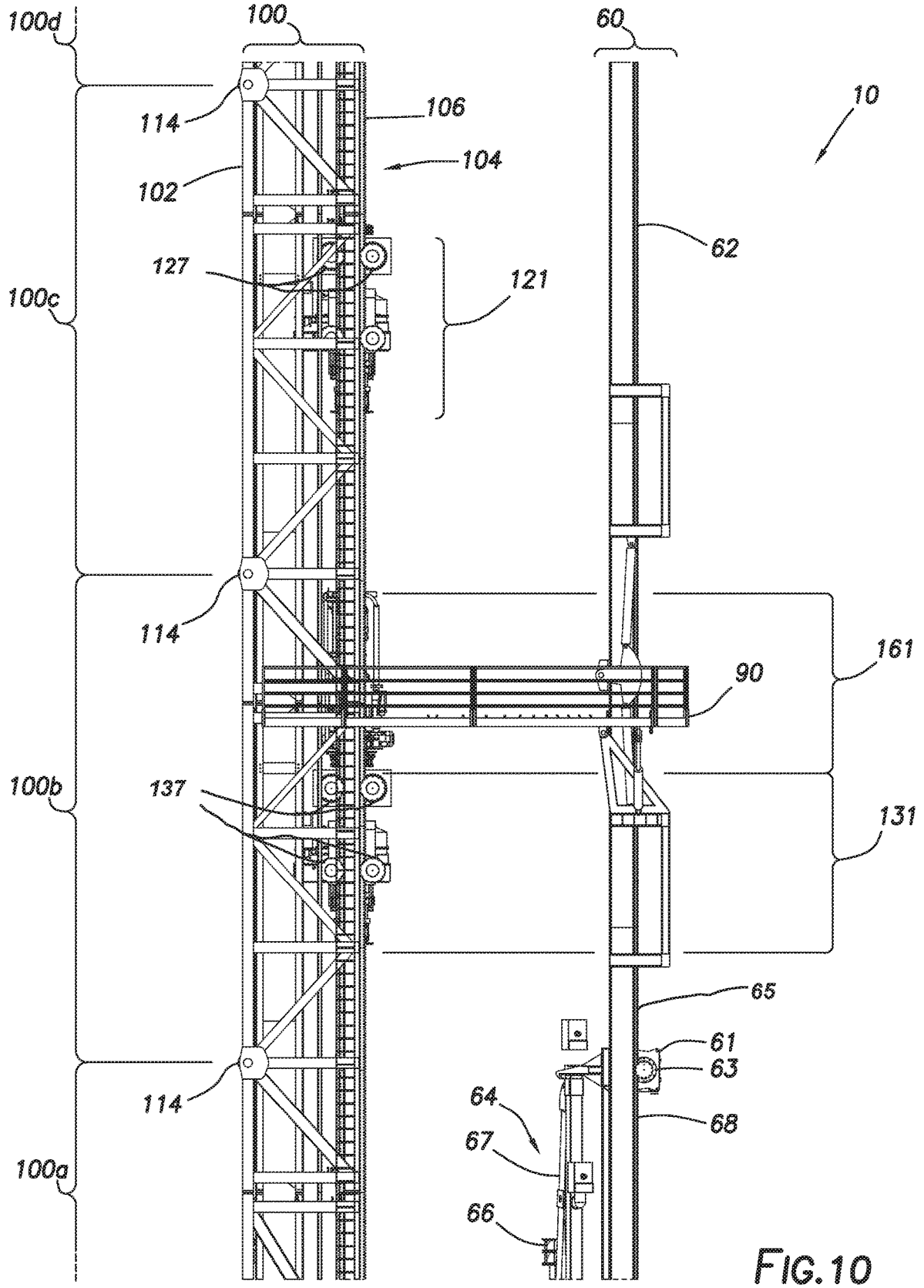
FIG. 10 depicts a partial side view of the mast and secondary mast of the drilling rig of FIGS. 1-3.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIGS. 1-10 depict perspective views of drilling rig 10. Drilling rig 10 may be positioned in wellsite 5. Wellsite 5 may include one or more wellheads 7. In some instances, wellheads 7 may be arranged in a linear fashion along wellsite 5. Each wellhead 7 may be the upper end of a wellbore extending into the Earth below or may represent a location at which such a wellbore will be drilled by drilling rig 10. In some embodiments, each wellhead 7 may include one or more components such as Christmas tree 8 or blowout preventer (BOP) 9. In some embodiments, as further discussed herein below, drilling rig 10 may be adapted to travel within wellsite 5 to, for example and without limitation, be used with each wellhead 7 in a drilling operation or otherwise.

Drilling rig 10 may include rig floor 12 and one or more support structures 14. Support structures 14 may be positioned to support rig floor 12 and other components of drilling rig 10 as further discussed below above ground level. In some embodiments, support structures 14 may include components to allow drilling rig 10 to be traveled through wellsite 5 as further discussed herein below.

In some embodiments, support structures 14 may be arranged such that support structures 14 and rig floor 12 form a trabeated structure. The open space between support structures 14 and below rig floor 12 may define at least one traverse corridor 16, indicated by traverse corridor axis 18 in FIGS. 1-10. In some embodiments, drilling rig 10 may be oriented such that traverse corridor axis 18 is substantially aligned with wellheads 7 of wellsite 5. In such an arrangement, as drilling rig 10 travels through wellsite 5 along the line of wellheads 7, such as, for example and without limitation, to move from drilling a first wellhead 7 to drill a second wellhead 7, drilling rig 10 may travel linearly in the direction of traverse corridor axis 18. Because no fixed components of support structures 14 or rig floor 12 are positioned in traverse corridor 16, drilling rig 10 may not interfere with any components of wellheads 7 such as, for example and without limitation, Christmas tree 8. In some embodiments, as depicted in FIGS. 1-10, drilling rig 10 may include two support structures 14 that define a single traverse corridor 16. In some embodiments, drilling rig 10 may include a larger number of support structures 14 arranged to define two or more traverse corridors 16, each having a separate traverse corridor axis 18 along which drilling rig 10 may linearly travel and avoid interference with any components of wellheads 7.

In some embodiments, rig floor 12 may include V-door 20. V-door 20 may be an open portion of one side of rig floor 12 through which tubular members such as casing, drill pipe, or other tools are passed when lifted into or lowered out of drilling rig 10. V-door 20 may be a physical opening in rig floor 12 or may be a designated area of rig floor 12 otherwise without other equipment that would impede the movement of tubular members and other tools. In some embodiments, tubular members may be introduced to drilling rig 10 using carrier 22 of catwalk system 24. Carrier 22, or other corresponding structure such as a slide, of catwalk system 24 may mechanically couple to the side of rig floor 12 that includes V-door 20, defined as V-door side 26 of rig floor 12. Catwalk system 24 may be used to store tubular members and other tools at the ground level before the tubular members and other tools are introduced to drilling rig 10 through V-door 20. In some embodiments, carrier 22 and catwalk system 24 may extend from V-door 20 of rig floor 12 in a direction substantially perpendicular to V-door side 26 of rig floor 12, the direction defining V-door axis 28. In some embodiments, rig floor 12 and support structures 14 may be positioned such that V-door axis 28 is substantially perpendicular to traverse corridor axis 18. In such an arrangement, catwalk system 24 is positioned at a location in wellsite 5 adjacent to drilling rig 10 but not in line with the line of wellheads 7, therefore avoiding interference between catwalk system 24 and wellheads 7.

In some embodiments, each support structure 14 may be adapted to be moved between a raised position and a lowered position. In such an embodiment, rig floor 12 and other components of drilling rig 10 coupled thereto may be moved between a raised position and a lowered position. In some embodiments, the raised position, as depicted in FIGS. 1-10, may be used when drilling rig 10 is in operation such that sufficient clearance exists between the ground level and rig floor 12 to permit rig floor 12 to clear any equipment needed for a drilling operation, such as, for example and without limitation, BOP 9 positioned on wellhead 7. In some embodiments, the lowered position may be used when "rigging up" or "rigging down" drilling rig 10 after transportation or in preparation for transportation. Lowering rig floor 12 may, for example and without limitation, allow easier access to components of rig floor 12 or equipment or structures coupled to rig floor 12 from the ground level. In some embodiments, by lowering support structures 14, the overall height of support structures 14 may be reduced for transportation.

In some embodiments, each support structure 14 may include lower box 50. Lower box 50 may be in contact with the ground and may support the weight of the rest of support structure 14 and drilling rig 10. In some embodiments, each support structure 14 may include one or more support beams 52. Each support beam 52 may pivotably couple to lower box 50 at lower pivot point 54 and to rig floor 12 at upper pivot point 56. In some embodiments, support beams 52 may form linkages between lower box 50 and rig floor 12 that allow rig floor 12 to move between the lowered position and the raised position as support beams 52 pivot relative to lower box 50 and rig floor 12. In some embodiments, support beams 52 may be arranged such that rig floor 12 remains generally parallel to the ground during the transition between the lowered and raised positions. In such an embodiment, support beams 52, lower boxes 50, and rig floor 12 may correspond to links in a parallelogram linkage.

In some embodiments, one or more diagonal support beams 58 may extend between lower boxes 50 and rig floor 12 to, for example and without limitation, retain rig floor 12 in the raised position.

In some embodiments, support structures 14 may include one or more mechanisms for traveling drilling rig 10 through wellsite 5. For example and without limitation, in some embodiments, support structures 14 may include walking actuators 30 as most clearly depicted in FIG. 9. Walking actuators 30 may be positioned in lower boxes 50. In some embodiments, walking actuators 30 may be adapted to lift lower boxes 50 off the ground, move drilling rig 10 a short distance, and lower lower boxes 50 to the ground. By repeatedly actuating walking actuators 30 in this way, drilling rig 10 may be moved through wellsite 5. In some embodiments, walking actuators 30 may be used to move drilling rig 10 between wellheads 7. In some embodiments, walking actuators 30 may be used to move drilling rig 10 along traverse corridor axis 18. In some embodiments, walking actuators 30 may rotate, allowing walking actuators 30 to move drilling rig 10 in directions other than along traverse corridor axis 18.

In some embodiments, drilling rig 10 may include additional equipment mechanically coupled to rig floor 12, support structures 14, or both. For example, in some embodiments, one or more of driller's cabin 40 and choke house 42 may be positioned on or cantilevered from rig floor 12. In some embodiments, mud gas separator skid 44 and stair tower skid 46 may mechanically couple to rig floor 12 and extend vertically downward from rig floor 12 to the ground level. In some embodiments, hydraulic power unit skid 47 and accumulator skid 48 may mechanically couple to support structures 14 and may be cantilevered or otherwise supported by support structures 14. In some embodiments, additional equipment including, for example and without limitation, mud tanks, trip tanks, process tanks, mud process equipment, compressors, variable frequency drives, or drill line spoolers, may be coupled to drilling rig 10. In some embodiments, equipment coupled to drilling rig 10, including, for example and without limitation, driller's cabin 40, choke house 42, mud gas separator skid 44, stair tower skid 46, hydraulic power unit skid 47, and accumulator skid 48, may travel with drilling rig 10 as it moves through wellsite 5. In some embodiments, drilling rig 10 may include one or more hoists or other equipment coupled to the lower side of rig floor 12 to transport BOP 9 with drilling rig 10 as it moves through wellsite 5.

In some embodiments, rig floor 12 may be moved between the raised and lowered position by one or more hydraulic cylinders. In some embodiments, hydraulic cylinders may extend between one or more lower boxes 50 and rig floor 12. In some embodiments, raising skid 70 may be mechanically coupled to drilling rig 10. In some embodiments, raising skid 70 may include raising skid base 72. Raising skid base 72 may mechanically couple to one or more of support structures 14. Raising skid 70 may include one or more raising actuators 74, which may be hydraulic cylinders coupled to raising skid base 72. Raising actuators 74 may be pivotably coupled to raising skid base 72. In some embodiments, raising actuators 74 may each be mechanically coupled to one or more corresponding drill floor raising points 76 of rig floor 12 by, for example and without limitation, a pin connection. Raising actuators 74 may be extended or retracted to move rig floor 12 to the raised or lowered position respectively. In some embodiments, raising skid 70 may be used to move mast 100 between a lowered position and a raised position as discussed further herein below. In some embodiments, raising skid 70 may be decoupled from drilling rig 10 once the desired raising or lowering operation is completed. In some embodiments, raising skid 70 may include one or more control units 78 for controlling operation of raising skid 70. In some embodiments, raising skid 70 may include hydraulic power unit 80 positioned to supply hydraulic pressure to extend or retract raising actuators 74.

Drilling rig 10 may include mast 100. Mast 100 may be mechanically coupled to rig floor 12 and/or support structures 14. In some embodiments, mast 100 may include one or more upright structures that define frame 102 of mast 100. In some embodiments, mast 100 may be rectangular in cross section. In some embodiments, frame 102 of mast 100 may include an open side defining mast V-door side 104. In some embodiments, mast V-door side 104 may be substantially open such that tubular members and other tools introduced through V-door 20 of rig floor 12 may enter into mast 100 as they are lifted into drilling rig 10. Mast V-door side 104 may be oriented to face V-door axis 28 such that mast V-door side 104 is aligned with V-door 20 of rig floor 12.

In some embodiments, drilling rig 10 may include racking board 90. Racking board 90 may be mechanically coupled to mast 100. Racking board 90 may, for example and without limitation, be used to store tubular members in a vertical position on drilling rig 10. In some embodiments, racking board 90 may include one or more fingerboards 92 positioned to define slots 94 in racking board 90 into which tubular members may be positioned for storage. In some embodiments, fingerboards 92 may be arranged such that slots 94 extend radially from the open middle of racking board 90 such that tubular members may be positioned radially into racking board 90 relative to a position at the middle of racking board 90.

In some embodiments, drilling rig 10 may include pipe handler assembly 60. Pipe handler assembly 60 may include secondary mast 62. Secondary mast 62 may mechanically couple to rig floor 12. In some embodiments, secondary mast 62 may mechanically couple to mast 100. In some embodiments, pipe handler assembly 60 may be positioned on rig floor 12 at a location corresponding to V-door 20. Pipe handler assembly 60 may include pipe handler 64. Pipe handler 64 may include pipe gripper 66. Pipe gripper 66 may be mechanically coupled to secondary mast 62 by pipe handler arm 67. Pipe handler arm 67 may mechanically couple to pipe handler carriage 68. Pipe gripper 66 of pipe handler 64 may be used to grip a tubular member or other tool from catwalk system 24 as the tubular member or other tool enters V-door 20. Pipe handler 64 may raise the tubular member or other tool by moving pipe gripper 66 and pipe handler arm 67 vertically by moving pipe handler carriage 68 relative to secondary mast 62. In some embodiments, pipe handler carriage 68 may include one or more motors 61 used to move pipe handler carriage 68 along secondary mast 62. In some embodiments, motors 61 may be used to rotate pinions 63 that engage with racks 65 coupled to secondary mast 62. In some embodiments, pipe handler 64 may position tubular members or other tools within drilling rig 10, such as, for example and without limitation, in line with well center within mast 100, into a storage position in racking board 90, or into alignment to be added to or removed from a drill string within the wellbore.

In some embodiments, mast 100 may include racks 106 mechanically coupled to frame 102. Racks 106 may be positioned on frame 102 of mast 100 at mast V-door side 104. Racks 106 may extend vertically substantially along the entire length of mast 100. Racks 106 may be used as part of one or more rack and pinion hoisting systems as further discussed herein below.

In some embodiments, mast 100 may be mechanically coupled to the rest of drilling rig 10 at one or more mast mounting points 108, 110. Mast mounting points 108, 110 may be coupled to rig floor 12 or may be coupled to support structures 14. In some embodiments, mast 100 may mechanically couple to mast mounting points 108, 110 by a pinned connection. In some embodiments, mast 100 may be pivotably coupled to a subset of mast mounting points 108, 110, such as mast mounting points 108, such that mast 100 may be pivotably raised or lowered when rigging up or down drilling rig 10, respectively. In some embodiments, mast 100 may be mechanically coupled to mast mounting points 108 in a lowered or horizontal arrangement. In some embodiments, mast 100 may be mechanically coupled to mast mounting points 108 when rig floor 12 is in the lowered position. In some embodiments, mast 100 may be moved between the raised or vertical position and the lowered or horizontal position by raising skid 70. In some such embodiments, raising actuators 74 of raising skid 70 may each be mechanically coupled to one or more corresponding mast raising points 112 of mast 100 by, for example and without limitation, a pin connection. Raising actuators 74 may be extended or retracted to move mast 100 to the raised or lowered position respectively. In some embodiments, mast 100 may be lowered in a direction substantially parallel to traverse corridor axis 18 or substantially perpendicular to traverse corridor axis 18.

In some embodiments, mast 100 may be constructed from two or more mast subcomponents, depicted in FIGS. 1-10 as mast subcomponents 100*a-d*. In some embodiments, in order to transport mast 100, mast subcomponents 100*a-d* may be decoupled from each other when mast 100 is in the lowered position and may each be transported separately. In some embodiments, as discussed further below, one or more pieces of equipment coupled to mast 100 may remain in one or more of mast subcomponents 100*a-d* during transportation to, for example and without limitation, reduce the number of loads needed to be transported and reduce the time taken to rig up or rig down drilling rig 10. In some embodiments, mast subcomponents 100*a-d* may be mechanically coupled upon reaching wellsite 5 to form mast 100. In some embodiments, mast subcomponents 100*a-d* may be mechanically coupled using, for example and without limitation, pin connections 114.

In some embodiments, one or more drilling machines may be mechanically coupled to mast 100 and may be used to raise and lower a drill string being used to drill a wellbore, to rotate the drill string, to position tubular members or other tools to be added to or removed from the drill string, and to make up or break out connections between tubular members. In some embodiments, such machines may include a top drive, elevator, or other hoisting mechanism.

In some embodiments, drilling rig 10 may include upper drilling machine (UDM) 121. UDM 121 may be used during a drilling operation to, for example and without limitation, raise and lower tubular members. As used herein, tubular members may include drill pipe, drill collars, casing, or other components of a drill string or components added to or removed from a drill string. In some embodiments, UDM 121 may include UDM clamps 123. UDM clamps 123 may be used, for example and without limitation, to engage a tubular member during a drilling operation. UDM 121 may be adapted to rotate the tubular member engaged by UDM clamps 123. In some embodiments, UDM 121 may include UDM slips 125. UDM slips 125 may be positioned to engage a tubular member to, for example and without limitation, allow UDM 121 to move the tubular member vertically relative to mast 100. In some embodiments, UDM 121 may include UDM pinions 127. UDM pinions 127 may engage racks 106 of mast 100. UDM pinions 127 may be driven by one or more motors including, for example and without limitation, hydraulic or electric motors, in order to move UDM 121 vertically along mast 100.

In some embodiments, mast 100 may include lower drilling machine (LDM) 131. LDM 131 may be used during a drilling operation to, for example and without limitation, raise and lower tubular members. As used herein, tubular members may include drill pipe, drill collars, casing, or other components of a drill string or components added to or removed from a drill string. In some embodiments, LDM 131 may include LDM clamps 133. LDM clamps 133 may be used, for example and without limitation, to engage a tubular member during a drilling operation. LDM 131 may be adapted to rotate the tubular member engaged by LDM clamps 133. In some embodiments, LDM 131 may include LDM slips 135. LDM slips 135 may be positioned to engage a tubular member to, for example and without limitation, allow LDM 131 to move the tubular member vertically relative to mast 100. In some embodiments, LDM 131 may include LDM pinions 137. LDM pinions 137 may engage racks 106 of mast 100. LDM pinions 137 may be driven by one or more motors including, for example and without limitation, hydraulic or electric motors, in order to move LDM 131 vertically along mast 100.

Figure 12:
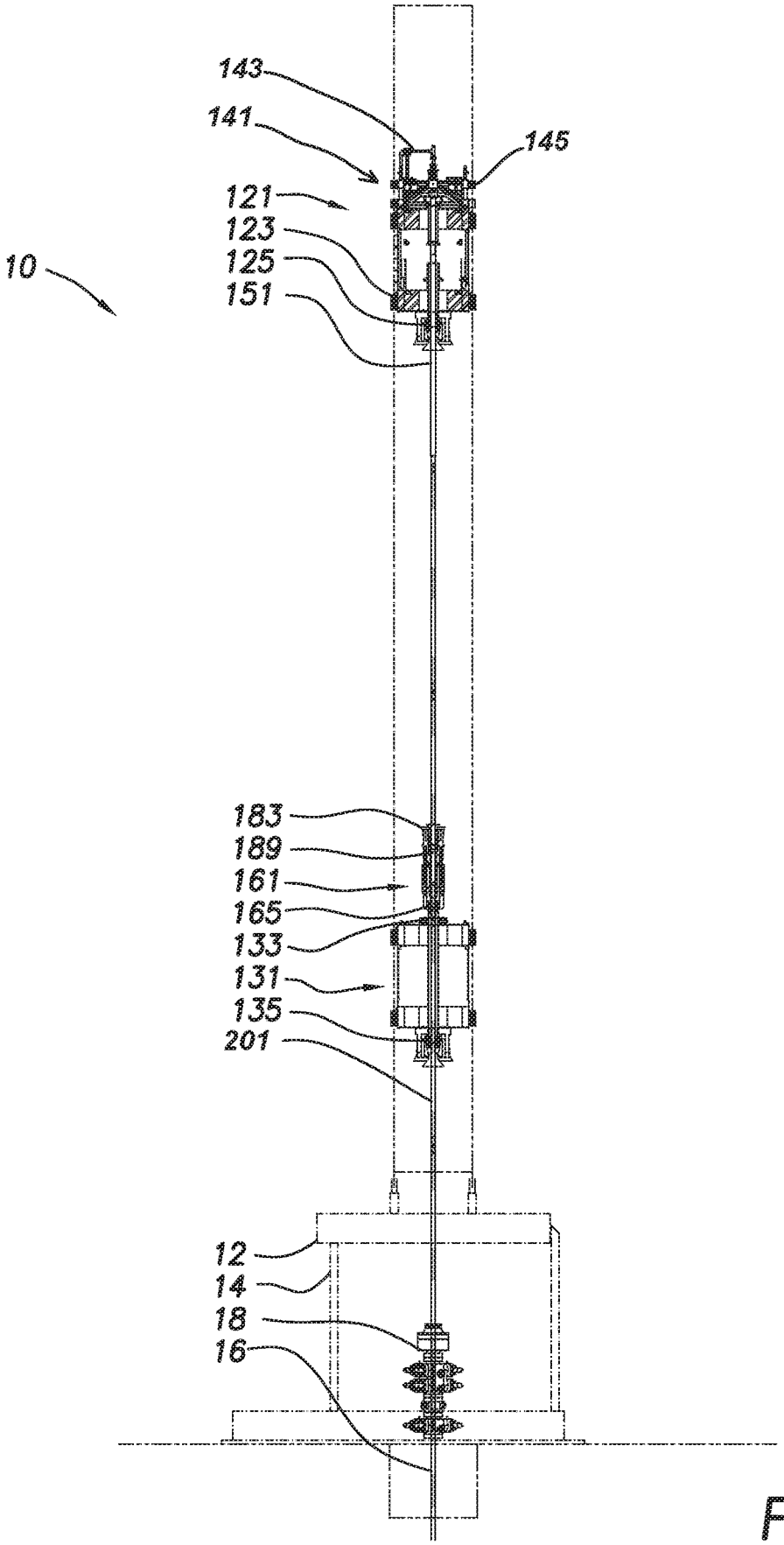
FIGS. 12-21A depict the drilling rig of FIG. 1 in various stages of a continuous drilling operation.

Referring briefly to FIG. 12, in some embodiments, mast 100 may also include a continuous drilling unit (CDU) 161. CDU 161 may be mechanically coupled to the upper end of LDM 131. The construction and operation of CDU 161 are described further herein below.

Referring again to FIG. 2, in some embodiments, UDM 121 and LDM 131 may each be moved independently relative to mast 100. In some embodiments, UDM 121 and LDM 131 may be operated to make-up and break-out connections between tubular members during rig operations including, for example and without limitation, drilling, tripping in, and tripping out operations. In some embodiments, UDM 121 and LDM 131 may each be positioned such that tubulars supported or gripped by UDM 121 or by LDM 131 are aligned with the front of mast 100 and therefore aligned with racks 106 of mast 100.

In some embodiments, mast 100 may include upper mud assembly (UMA) 141. UMA 141 may include drilling mud supply pipe 143 adapted to supply drilling fluid to a tubular member gripped by UDM 121. Drilling mud supply pipe 143 may fluidly couple to the tubular member gripped by UDM 121 and may, for example and without limitation, be used to supply drilling fluid to a drill string during portions of a drilling operation. In some embodiments, UMA 141 may include mud assembly pinions 145 (shown in FIG. 12). Mud assembly pinions 145 may engage racks 106 of mast 100. In some embodiments, mud assembly pinions 145 may be driven by one or more motors including, for example and without limitation, hydraulic or electric motors, in order to move UMA 141 vertically along mast 100. In other embodiments, UMA 141 may be moved by UDM 121. In other embodiments, UMA 141 may be moved using a separate hoist such as an air hoist. Such a hoist may include sheaves positioned on mast 100.

In some embodiments, in order to rig-down mast 100 for transport, components of mast 100 may be repositioned within mast 100 such that each is positioned within a specific mast subcomponents 100*a-d* as discussed below. The following discussion is meant as an example of such a rigging-down operation and is not intended to limit the scope of this disclosure as other arrangements of components and mast subcomponents are contemplated within the scope of this disclosure.

In such a rigging-down operation, any tubular members may be removed from all components of mast 100. In some embodiments, LDM 131 may be lowered into first mast subcomponent 100*a*. First mast subcomponent 100*a* may, in some embodiments, be the lowermost of mast subcomponents 100*a-d*. LDM 131 may be lowered using LDM pinions 137. In some embodiments, CDU 161 may be removed from LDM 131 and may be transported separately from the rest of mast 100.

In some embodiments, UDM 121 may be lowered into second mast subcomponent 100*b*. Second mast subcomponent 100*b* may, in some embodiments, be the second lowermost of mast subcomponents 100*a-d*. UDM 121 may be lowered using UDM pinions 127. In some embodiments, UMA 141 may be positioned within third mast subcomponent 100*c*. Third mast subcomponent 100*c* may, in some embodiments, be the third lowermost of mast subcomponents 100*a-d*. In some embodiments, UMA 141 may be positioned using one or more of UDM 121, mud assembly pinions 145, or another hoist such as an air hoist.

In some embodiments, mast subcomponents 100*a*-100*d* of mast 100 may be decoupled as discussed herein above, such that each mast subcomponent 100*a*-100*d* including any components of mast 100 positioned therein may be transported separately. Each mast subcomponent 100*a*-100*d* may be transported, for example and without limitation, by a truck-drawn trailer. In such an embodiment, first mast subcomponent 100*a* may be transported with LDM 131, second mast subcomponent 100*b* may be transported with UDM 121, and third mast subcomponent 100*c* may be transported with UMA 141. In some embodiments, the lengths of each mast subcomponent 100*a*-100*d* may be selected such that the overall weight of the transported section is within a desired maximum weight. In some embodiments, the lengths of each mast subcomponent 100*a*-100*d* may be selected such that the lengths and weights thereof comply with one or more transportation regulations including, for example and without limitation, permit load ratings. In some embodiments, such an arrangement may allow components that would otherwise be too heavy to transport as a single load to be separated into multiple loads.

In some embodiments, CDU 161 may be mechanically coupled to an upper end of LDM 131 once mast 100 is fully rigged up to drilling rig 10. As depicted in cross section in FIG. 11, CDU 161 may include lower seal housing 163. Lower seal housing 163 may mechanically couple CDU 161 to LDM 131. Lower seal 165 may be positioned within lower seal housing 163 and may be positioned to seal against an upper end of a tubular member 200. In some embodiments, tubular member 200 may be the uppermost tubular member of a drill string. In some embodiments, lower seal 165 may be positioned to seal against tubular member 200 while tubular member 200 is gripped by one or both of LDM clamps 133 and LDM slips 135 (not shown in FIG. 11) during a drilling operation. Lower seal housing 163 may mechanically couple to circulation housing 167. Circulation housing 167 may include one or more fluid inlets 169 positioned to allow drilling fluid to enter the interior of circulation housing 167 and flow into tubular member 200, defining a lower flow path.

Circulation housing 167 may mechanically couple to valve housing 171. Valve housing 171 houses valve 173 positioned to, when closed, isolate the interior of CDU 161 below valve 173, defining lower chamber 175, from the interior of CDU 161 above valve 173, defining upper chamber 177. Lower chamber 175 may be defined between valve 173 and lower seal 165 and may be in fluid communication with inlets 169. Valve 173 may, in some embodiments, be a flapper valve.

Figure 11:
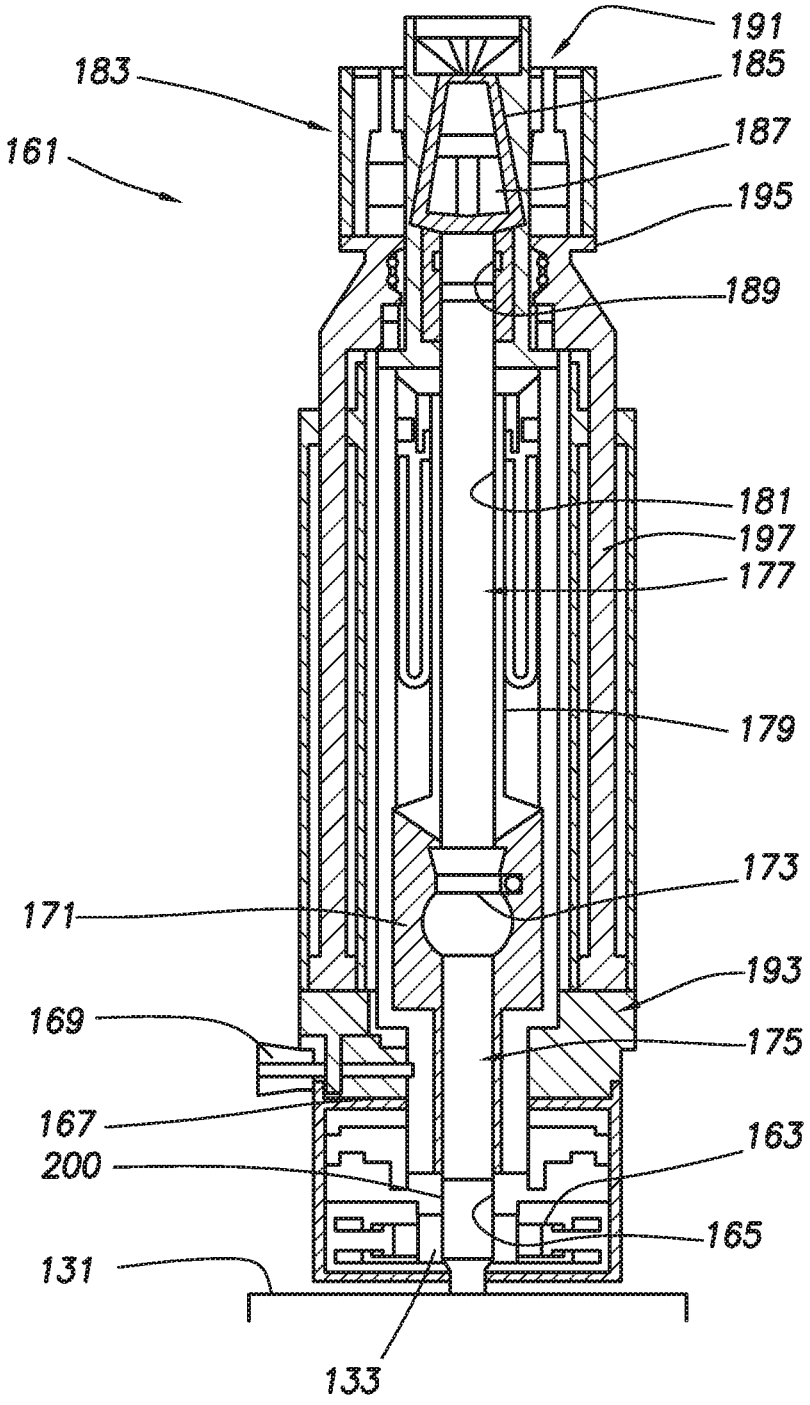
FIG. 11 depicts a cross-section view of a continuous drilling unit (CDU) consistent with at least one embodiment of the present disclosure.

Valve housing 171 may mechanically couple to outer extension barrel 179. Outer extension barrel 179 may be positioned about inner extension barrel 181. Inner extension barrel 181 may slide telescopically within outer extension barrel 179 between a retracted configuration (as shown in FIG. 11) and an extended configuration as further discussed below.

The upper end of inner extension barrel 181 may be mechanically coupled to inverted slips assembly 183. Inverted slips assembly 183 may include slips bowl 185 and one or more wedges 187 positioned to grip to a tubular member as further discussed below. Inner extension barrel 181 may also be mechanically coupled to upper seal 189. Upper seal 189 may be positioned to seal against the outer surface of a tubular member held by inverted slips assembly 183. Upper seal 189 may define an upper end of upper chamber 177. In some embodiments, lower seal housing 163, lower seal 165, circulation housing 167, valve housing 171, valve 173, outer extension barrel 179, inner extension barrel 181, inverted slips assembly 183, and upper seal 189 may define a rotating portion of CDU 161 and may be rotated as a unit by rotation of a tubular member held by inverted slips assembly 183.

In some embodiments, CDU 161 may include a nonrotating outer housing assembly 191. Outer housing assembly 191 may include lower housing 193 and upper housing 195. Like lower seal housing 163, lower housing 193 may be mechanically coupled to LDM 131. Upper housing 195 may be coupled to lower housing 193 by one or more linear actuators 197 to move upper housing 195 axially relative to lower housing 193. In some embodiments, linear actuators 197 may be hydraulic pistons, electromechanical actuators, or any other suitable devices.

In some embodiments, lower seal housing 163, lower seal 165, circulation housing 167, valve housing 171, valve 173, and outer extension barrel 179 may be rotatably mechanically coupled to lower housing 193. In some embodiments, inner extension barrel 181, inverted slips assembly 183, and upper seal 189 may be mechanically coupled to upper housing 195. In some embodiments, one or more bearings may be positioned between components of the rotating portion of CDU 161 and components of outer housing assembly 191.

Upper housing 195 may be moved axially between an extended configuration and a retracted configuration to define an extended configuration and a retracted configuration of CDU 161. As upper housing 195 moves, inner extension barrel 181 moves relative to outer extension barrel 179 while maintaining a seal and thereby maintaining upper chamber 177.

During operation, a tubular member may be inserted into CDU 161 such that the lower end of the tubular member is positioned above valve 173 within upper chamber 177 while upper housing 195 is in the extended configuration and gripped by inverted slips assembly 183, and upper seal 189. Upper housing 195 may then be moved axially with respect to lower housing 193 to the retracted configuration, thereby pushing the lower end of the tubular member through valve 173 into lower chamber 175. In some embodiments, the lower end of the tubular member may be positioned into contact with tubular member 200 in order to make-up a threaded connection therebetween. Likewise, once a connection is broken out, upper housing 195 may be moved to the extended configuration, moving the lower end of an upper tubular member from lower chamber 175 into upper chamber 177, allowing valve 173 to close and isolate lower chamber 175 from upper chamber 177.

In some embodiments, drilling rig 10 with mast 100 as described above may be used during normal drilling operations including, for example and without limitation, conventional drilling, tripping in and out, or other operations. In some such embodiments, UDM 121 or LDM 131 may be used to hoist, position, and rotate a drill string. In some embodiments, UDM 121 and LDM 131 may be used to make up or break out pipe connections to add or remove tubular members from the drill string as discussed herein below with or without the use of UMA 141 and CDU 161. Pipe handler assembly 60 may be used to add or remove tubulars during such operations.

In some embodiments, drilling rig 10 may be used during a continuous drilling operation. In such an embodiment, UDM 121, LDM 131, UMA 141, and CDU 161 may be used to continuously circulate drilling fluid through the drill string during drilling operations without stopping or slowing the rotation of or penetration by the drill string into the subsurface formation during the addition of additional tubular members to the drill string.

For example, FIGS. 12-21 depict a continuous drilling operation consistent with embodiments of the present disclosure as further described below.

FIG. 12 depicts drilling rig 10 during a continuous drilling operation at a stage in the cycle at which UDM 121 is handling the drilling operation. In some embodiments, quill extension 151 may be positioned within UDM 121. Quill extension 151 may be engaged by UDM clamps 123 and UDM slips 125. Quill extension 151 may be coupled to UMA 141 such that UMA 141 allows drilling fluid to flow into quill extension 151, defining an upper flow path. As shown in FIG. 12, quill extension 151 is threadedly coupled to the upper end of drill string 201 such that rotation of quill extension 151 by UDM 121 is transferred to drill string 201 and such that drilling fluid from UMA 141 is circulated through drill string 201. In some embodiments, such as where drilling rig 10 is used for conventional drilling, UMA 141 may supply drilling fluid to drill string 201 directly. UDM 121 rotates drill string 201 at the desired drilling speed and moves downward as drill string 201 penetrates further into the subterranean formation. At this stage, LDM 131 and CDU 161 are not engaged with drill string 201. Specifically, LDM clamps 133, LDM slips 135, lower seal 165, inverted slips assembly 183, and upper seal 189 are disengaged from drill string 201. CDU 161 may be in the retracted configuration. Fluid supply from the lower flow path to inlets 169 is closed, and the weight of drill string 201 is supported by UDM 121.

Figure 13:
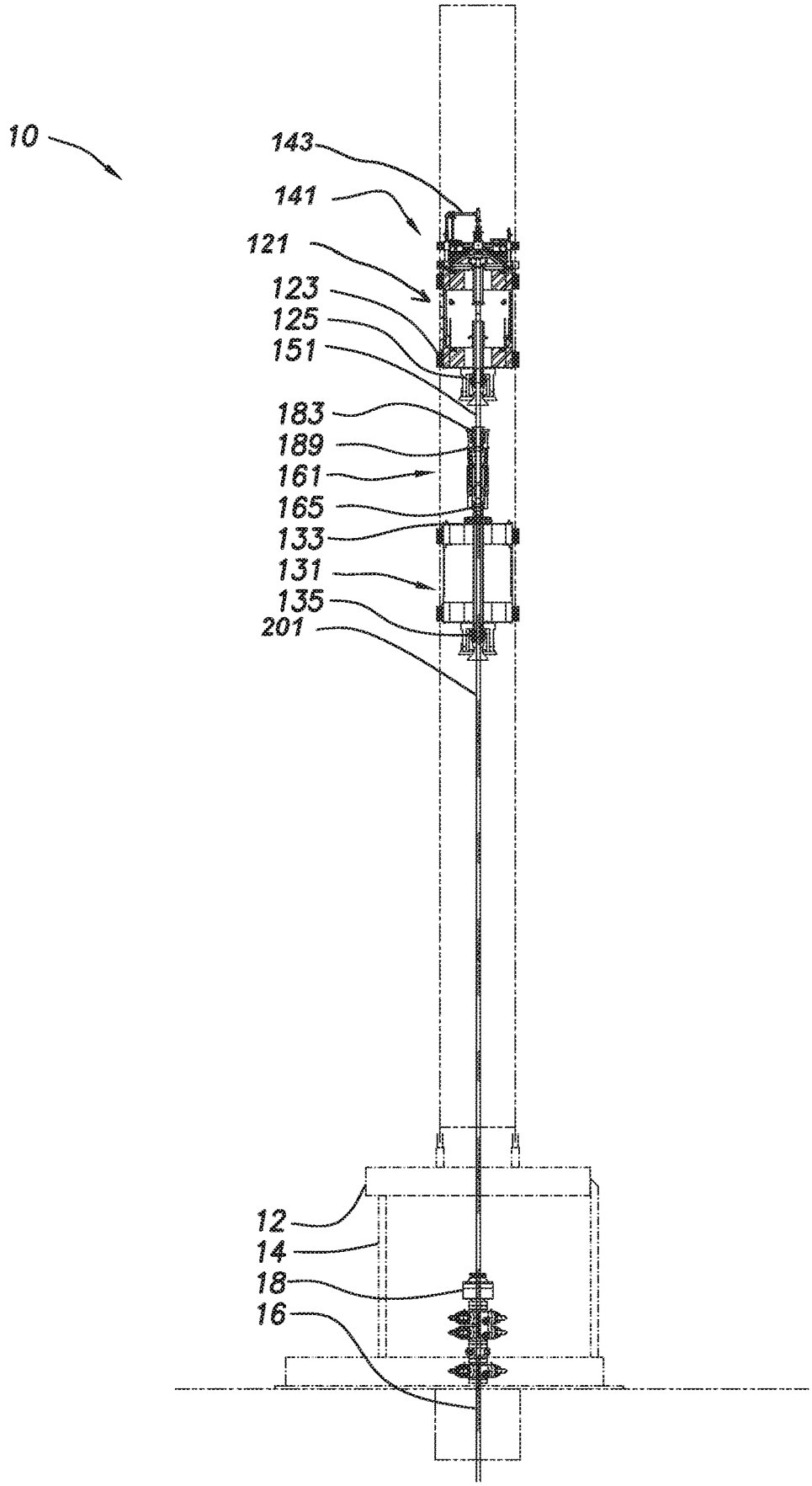
Figure 13A:
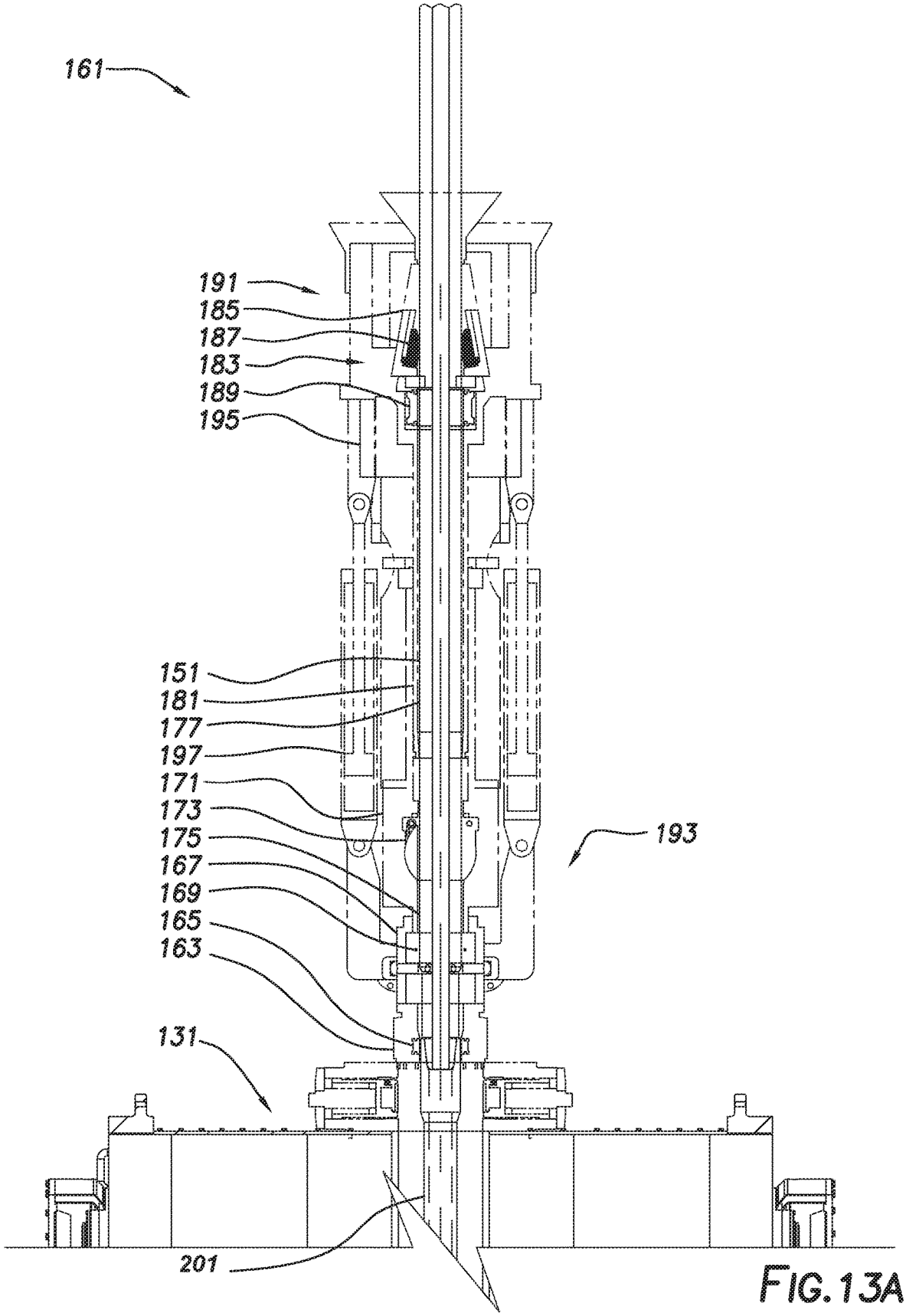

As shown in FIGS. 13 and 13A, LDM 131 may be moved up to a position at which the upper end of drill string 201 is positioned within lower chamber 175 of CDU 161 while quill extension 151 extends through upper chamber 177 and into lower chamber 175 of CDU 161. LDM 131 may be moved downward such that this alignment is maintained despite downward motion of drill string 201 and UDM 121 during the drilling operation.

Figure 13B:
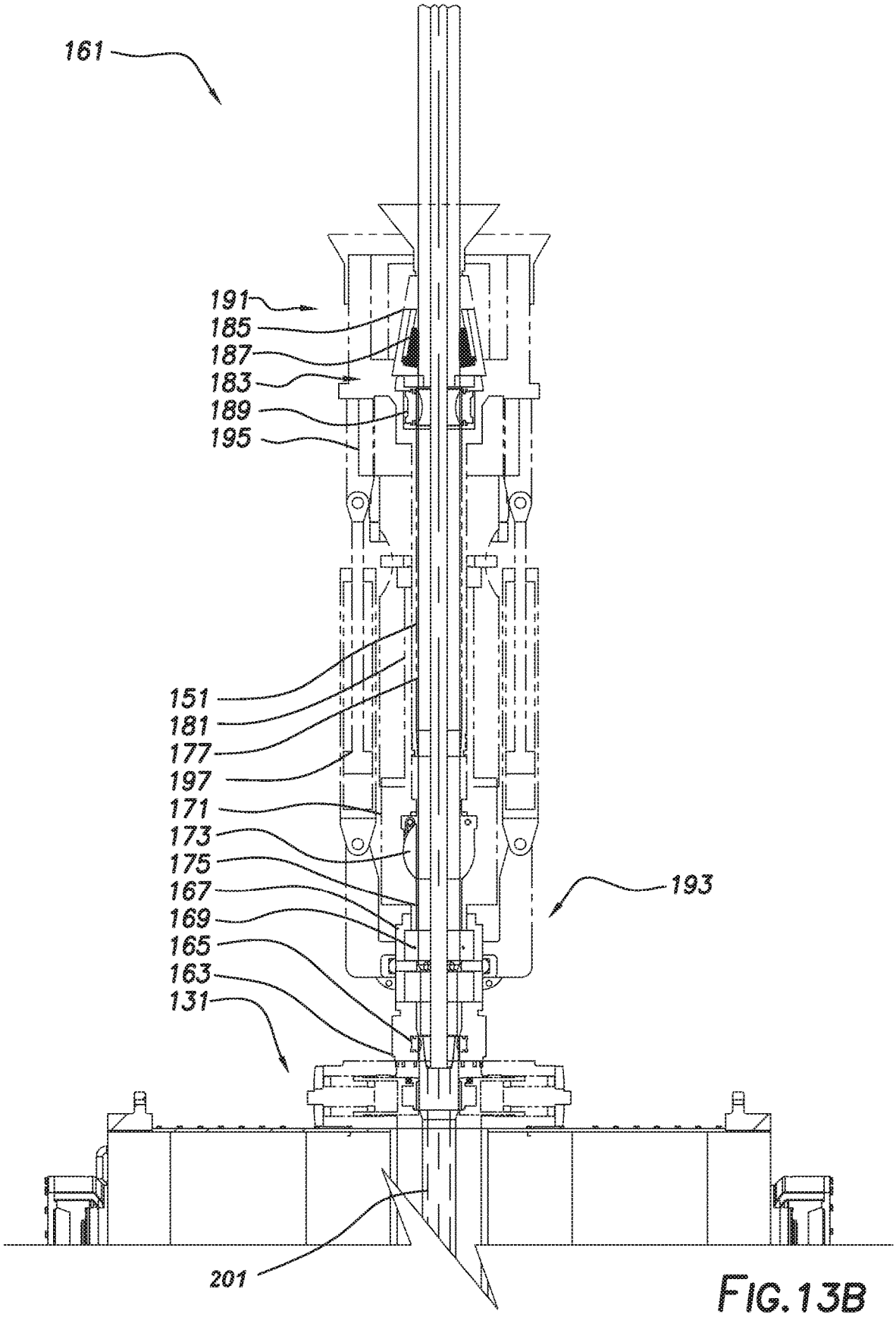
Figure 13C:
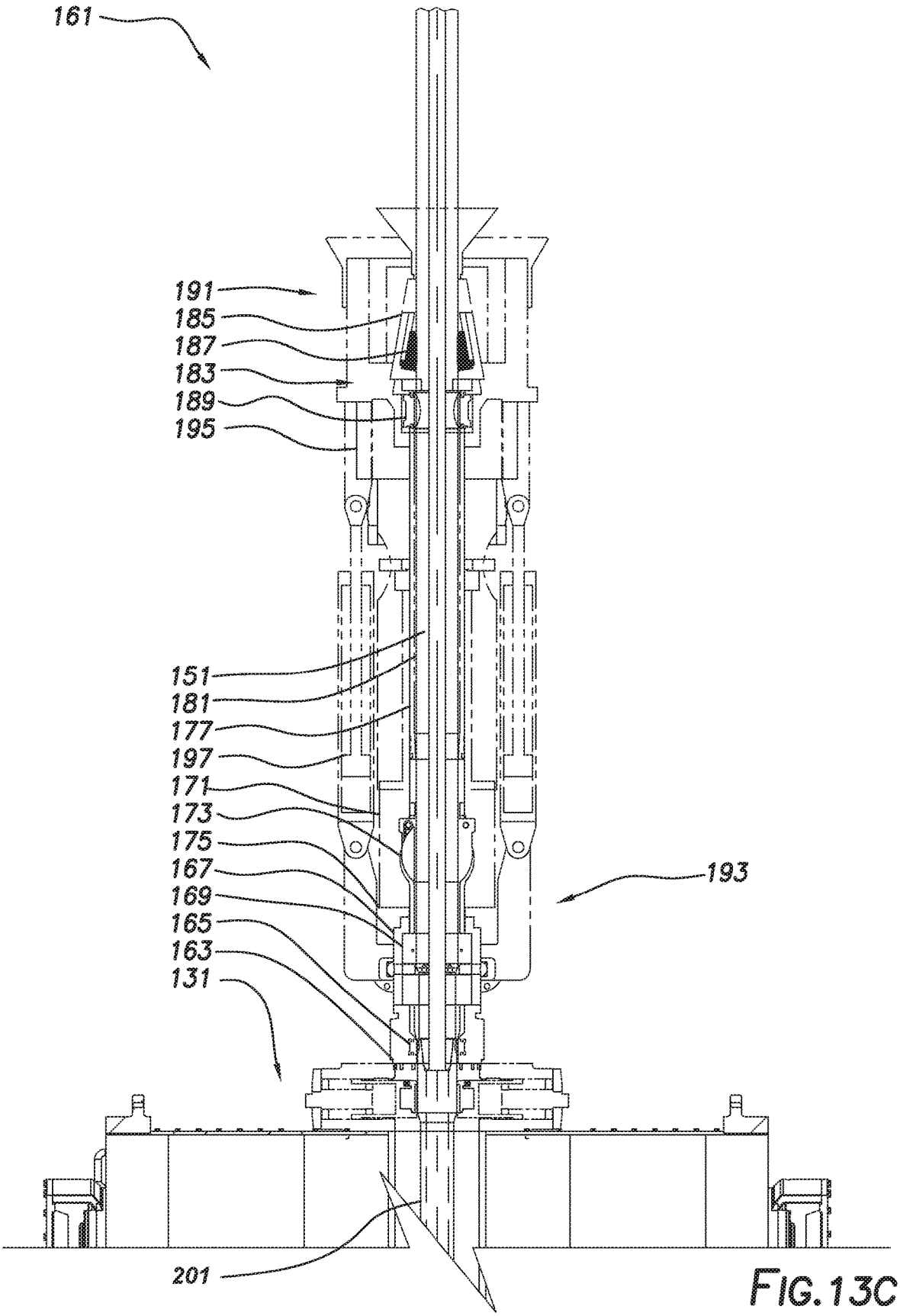

Once LDM 131 is so aligned, LDM 131 may begin to rotate LDM clamps 133 and LDM slips 135 at a speed to match the rotation of drill string 201, i.e. drilling speed. Once the rotation rate is matched, LDM clamps 133 and LDM slips 135 may each be actuated to engage drill string 201. The weight of drill string 201 may thus be transferred from UDM 121 to LDM 131 while both engage drill string 201. Inverted slips assembly 183, and upper seal 189 may be actuated to engage quill extension 151 and lower seal 165 may be actuated to engage drill string 201 as shown in FIG. 13B. The rotating components of CDU 161 may be rotated by rotation of quill extension 151 at the drilling speed. The lower flow path may then be opened to introduce drilling fluid into upper chamber 177 and lower chamber 175 of CDU 161 through inlets 169, equalizing the pressure therein with the pressure in drill string 201 as shown in FIG. 13C.

Figure 14:
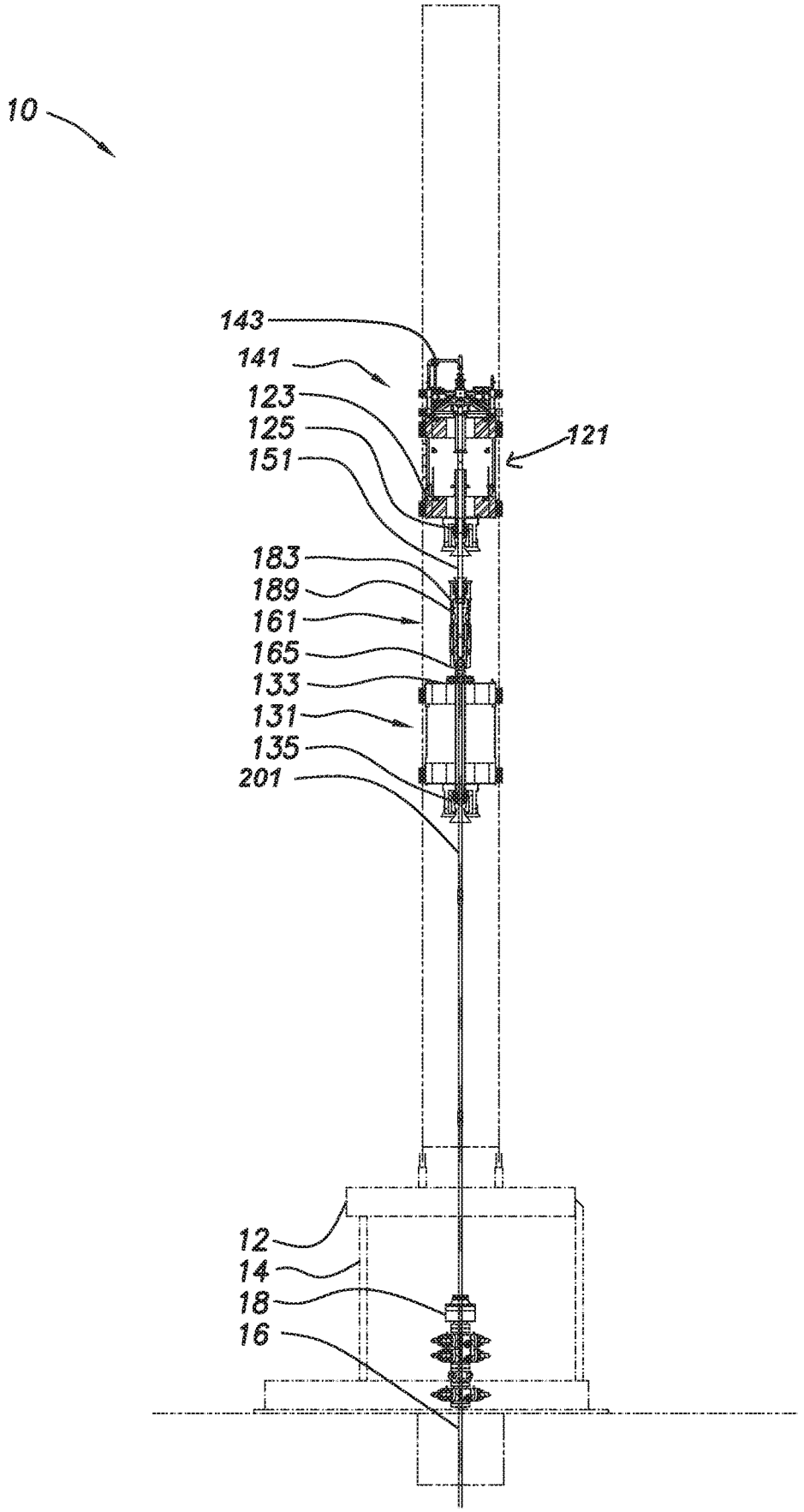
Figure 14A:
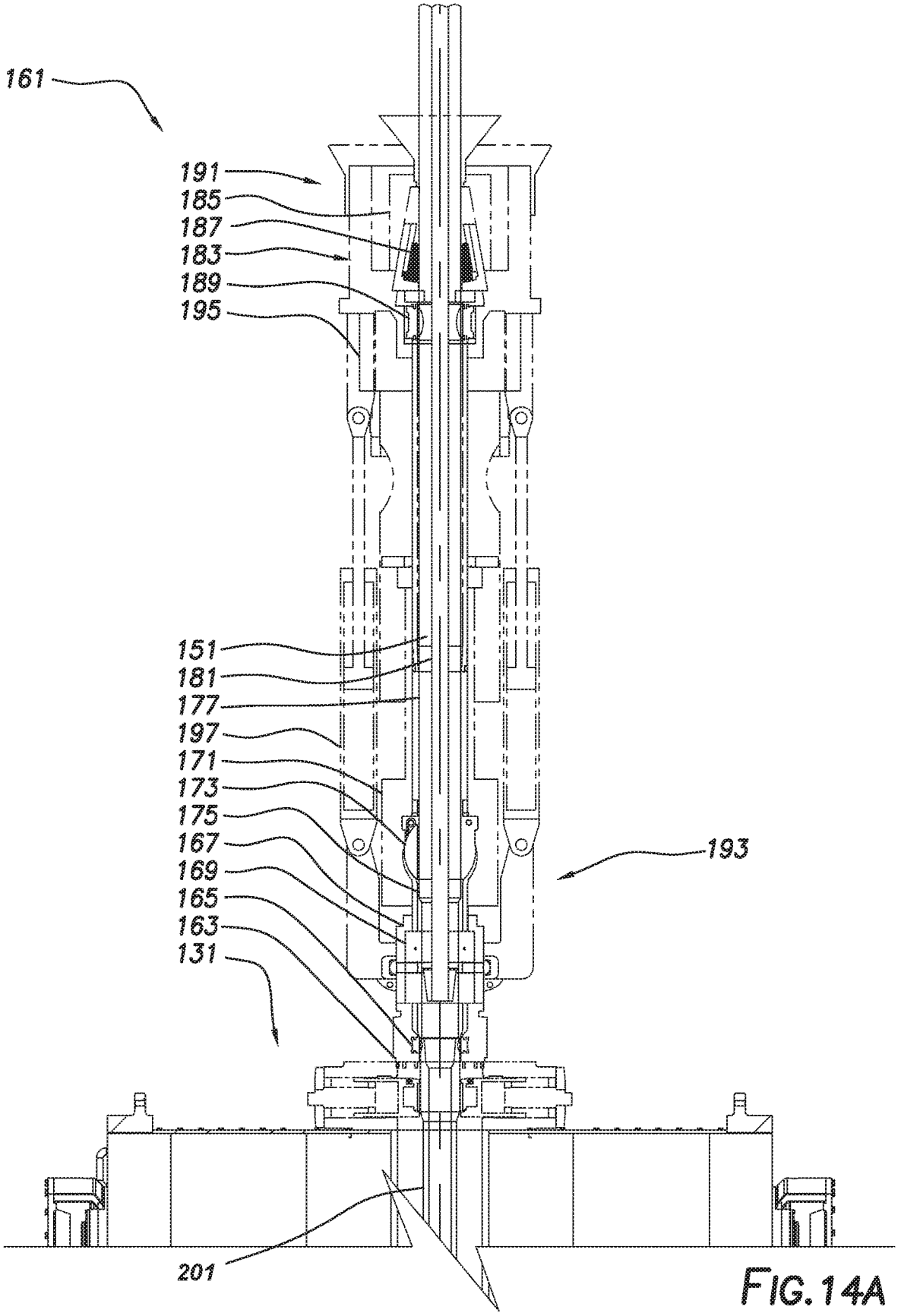

The threaded connection between quill extension 151 and drill string 201 may then be broken-out. As LDM 131 rotates drill string 201 at the drilling speed, UDM 121 may slow rotation of quill extension 151 causing the threaded connection between drill string 201 and quill extension 151 to be broken-out as shown in FIGS. 14 and 14A. UDM 121 may move upward relative to LDM 131 to account for the disengagement of the threaded connection. Likewise, CDU 161 may partially extend to account for the disengagement of the threaded connection. In other embodiments, one or more vertical cylinders may be included as part of UDM 121 or LDM 131 to account for the disengagement of the threaded connection. Once drill string 201 is disconnected from quill extension 151, drilling fluid may enter drill string 201 from the lower flow path via inlets 169, and the upper flow path through UMA 141 may be closed. Rotation of quill extension 151 by UDM 121 may be halted once the connection is broken-out. At this point, LDM 131 bears all the weight and provides the rotational force on drill string 201.

Figure 15:
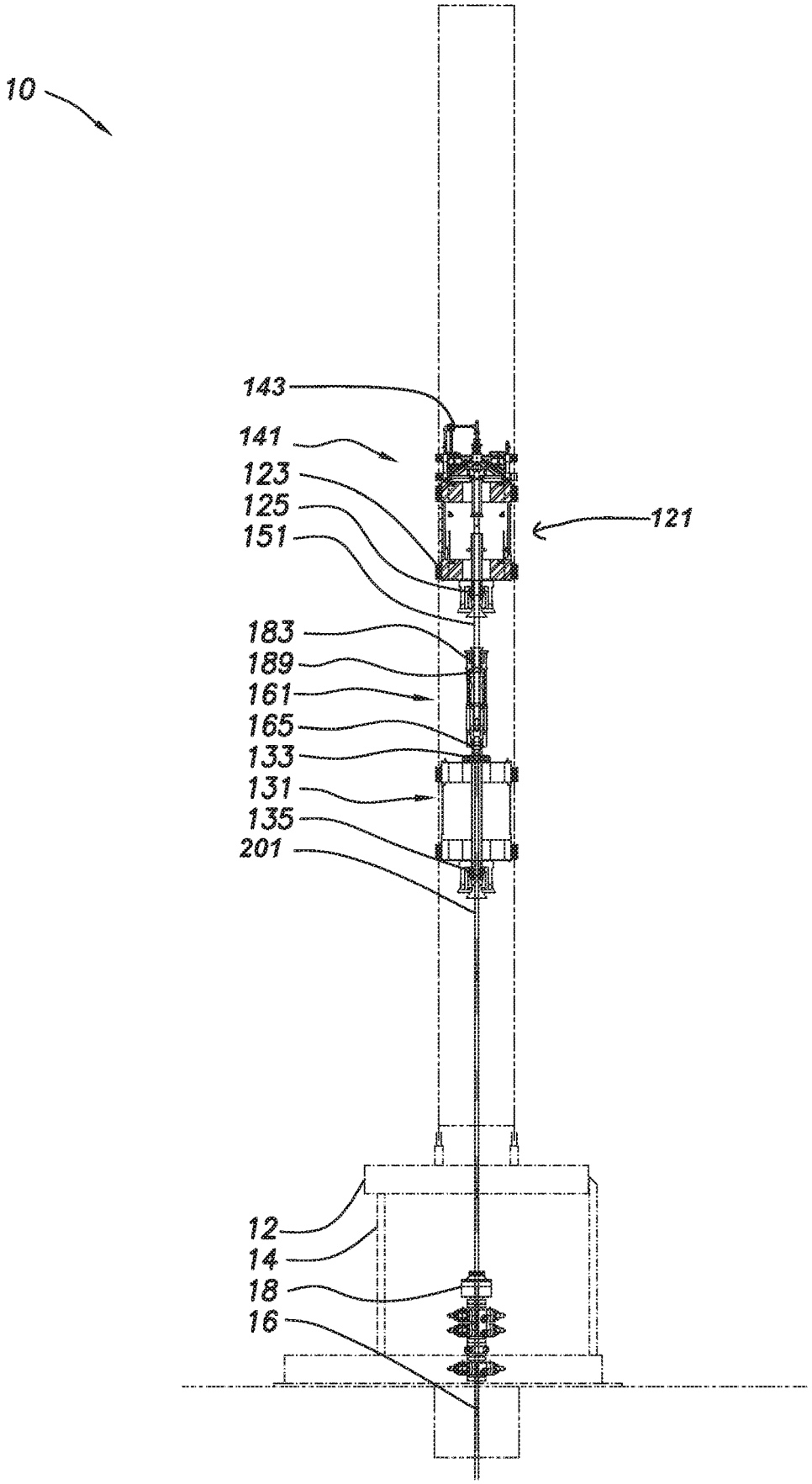
Figure 15A:
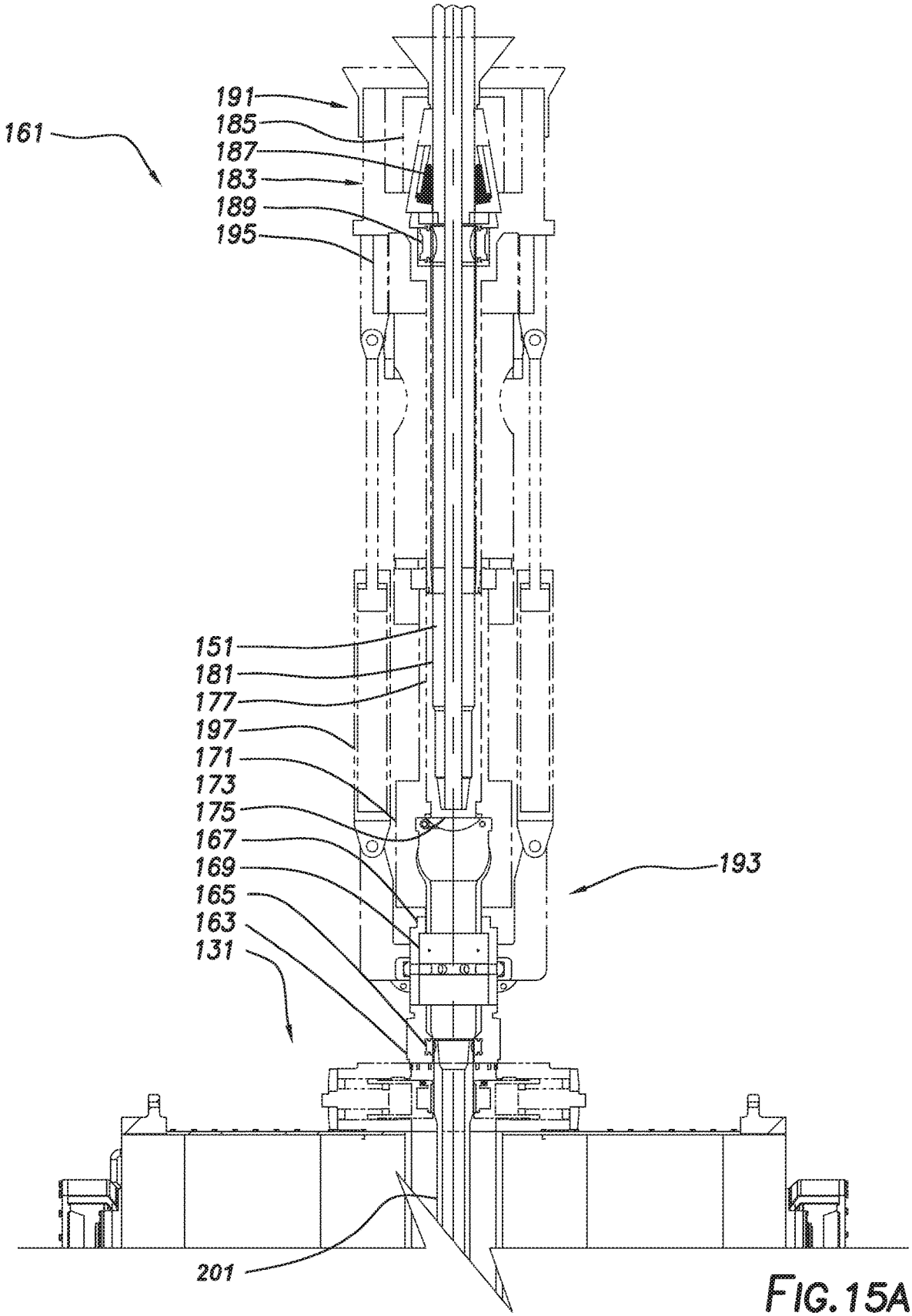
Figure 15B:
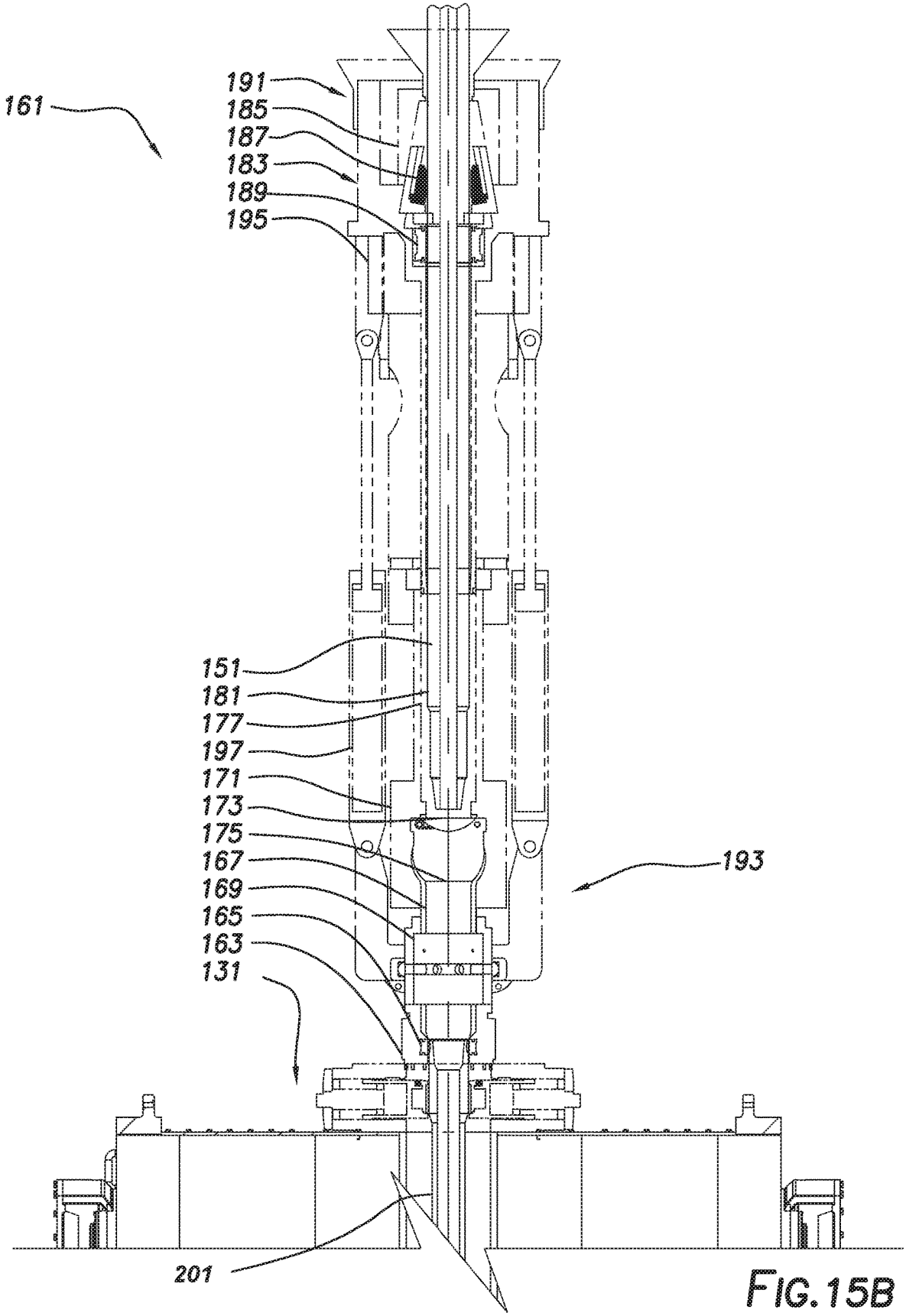
Figure 16:
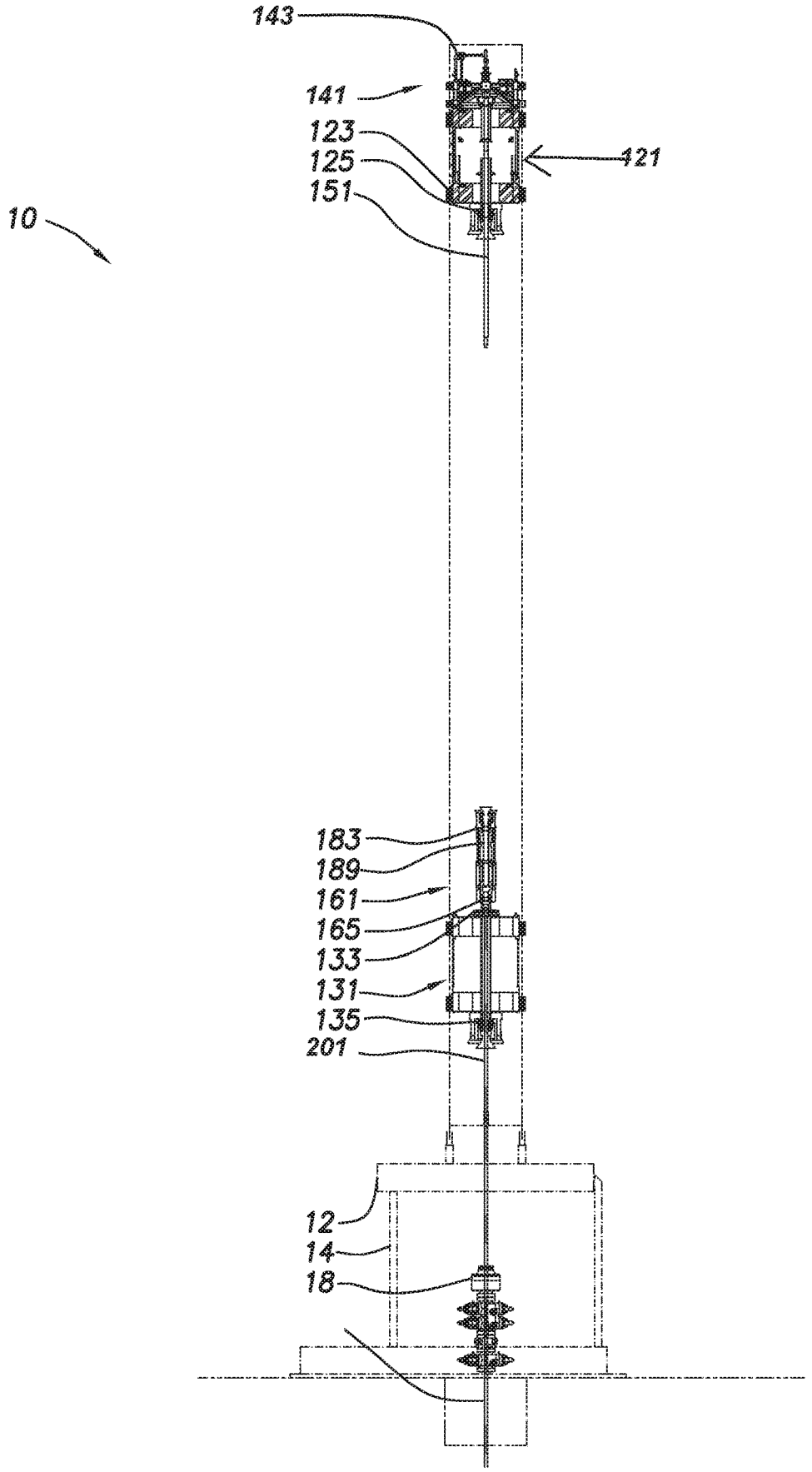

CDU 161 may then fully extend such that the lower end of quill extension 151 moves upward out of lower chamber 175 and into upper chamber 177 of CDU 161 as shown in FIGS. 15 and 15A. Valve 173 may close, isolating lower chamber 175 from upper chamber 177. Upper chamber 177 may be depressurized and fluid within upper chamber 177 and quill extension 151 may be drained. Inverted slips assembly 183 and upper seal 189 may be disengaged from quill extension 151 as shown in FIG. 15B. UDM 121 is disengaged from drill string 201 and may be moved to a raised position relative to mast 100 while LDM 131 runs the drilling operation as shown in FIG. 16.

Figure 17:
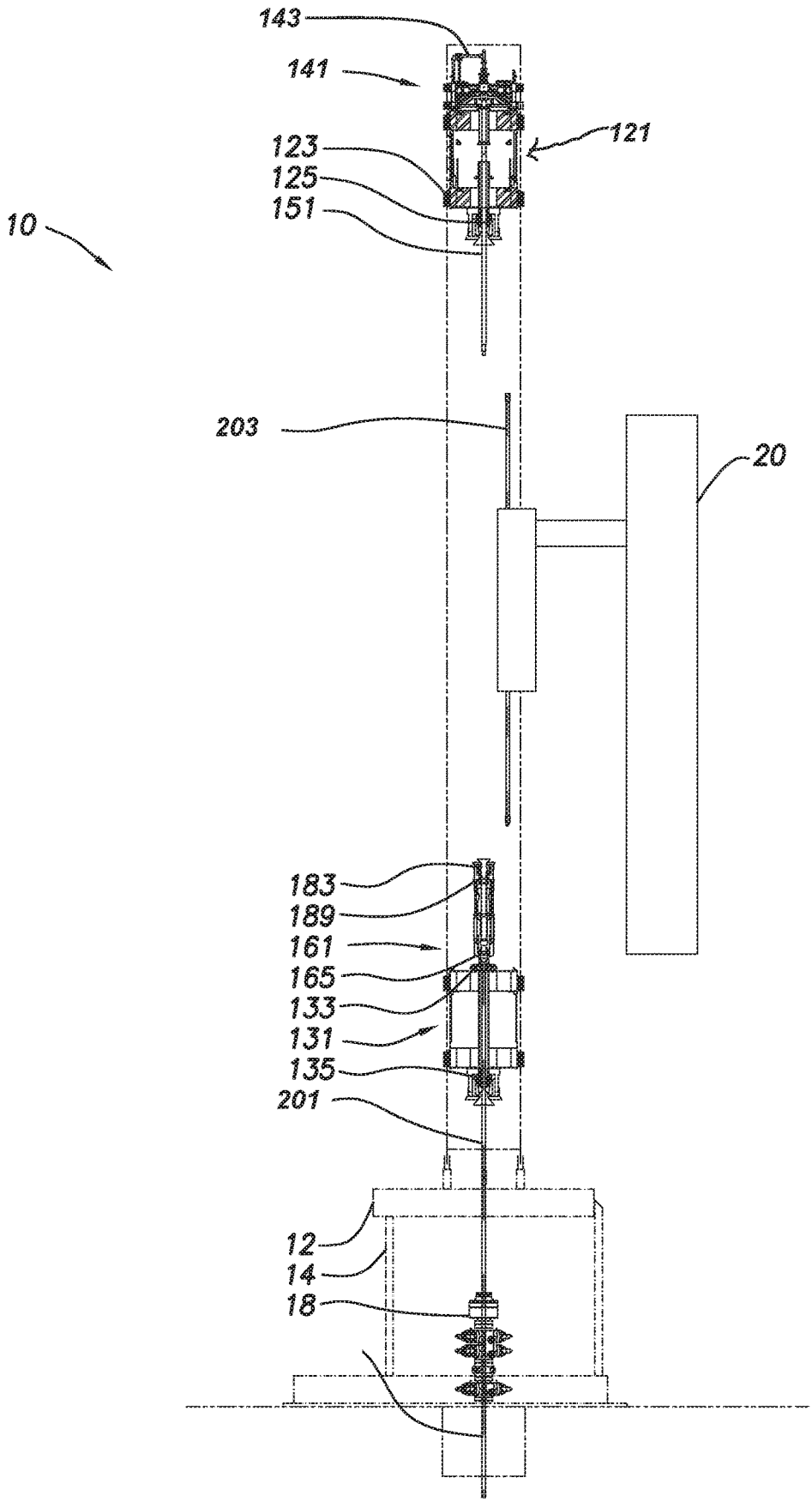

Pipe handler assembly 60 may move a tubular to be added to drill string 201, defined as next drill pipe 203, into position and allow it to be threadedly coupled to the lower end of quill extension 151 as shown in FIG. 17. In some embodiments, the connection between quill extension 151 and next drill pipe 203 may be made-up by rotation of quill extension 151 by UDM 121. In other embodiments, pipe handler assembly 60 may rotate next drill pipe 203 relative to quill extension 151.

Figure 18:
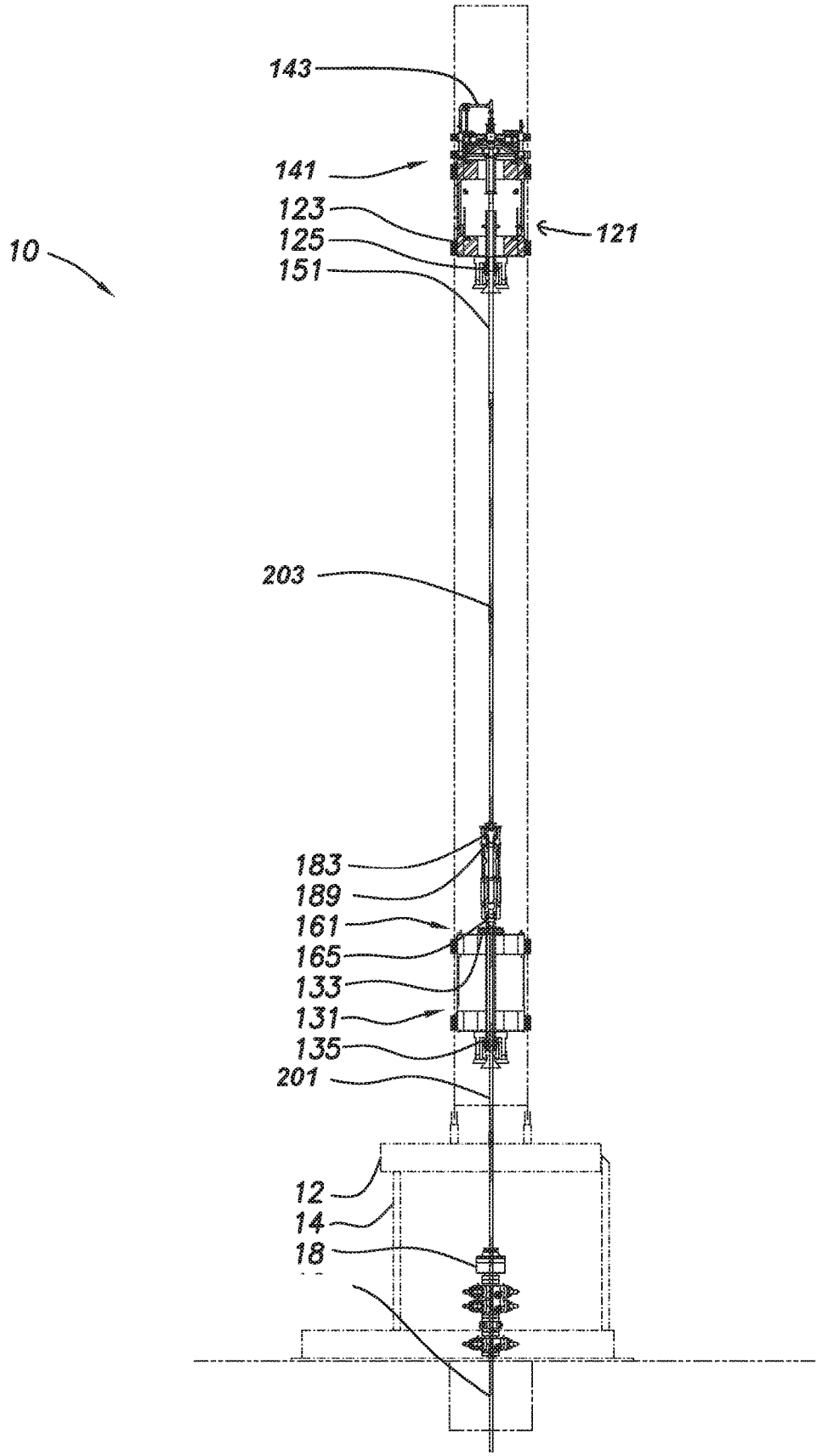
Figure 18A:
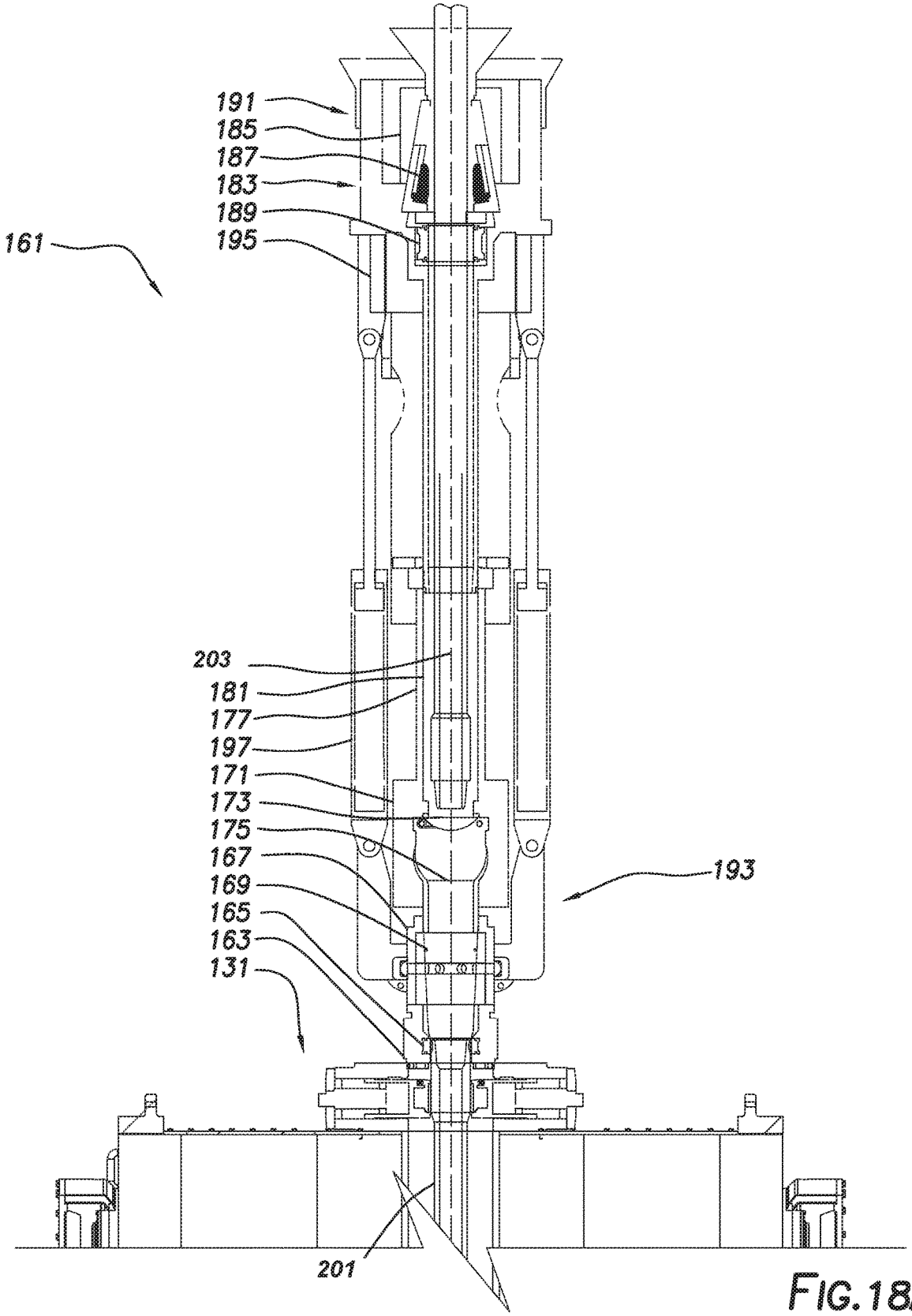
Figure 18B:
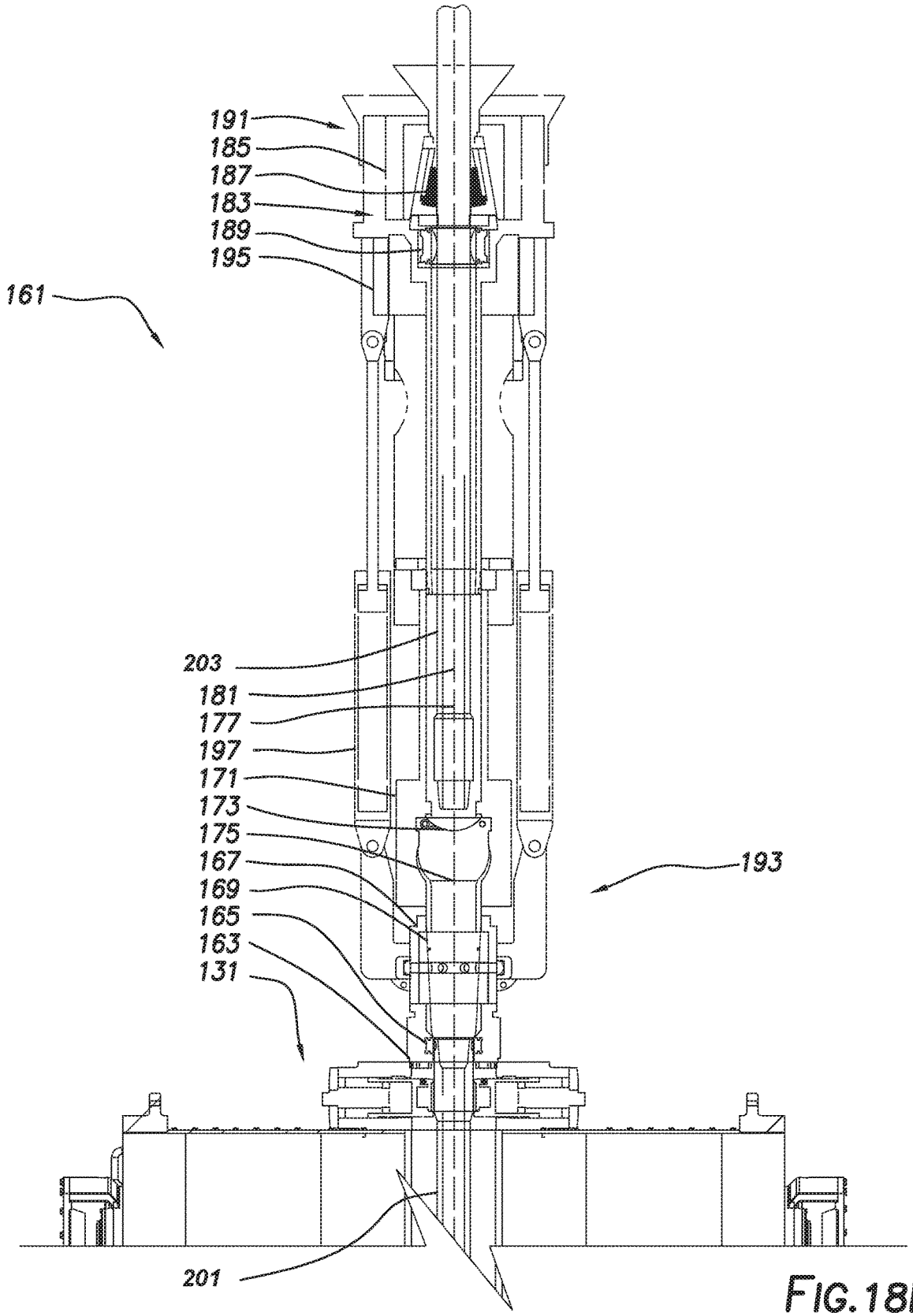
Figure 18C:
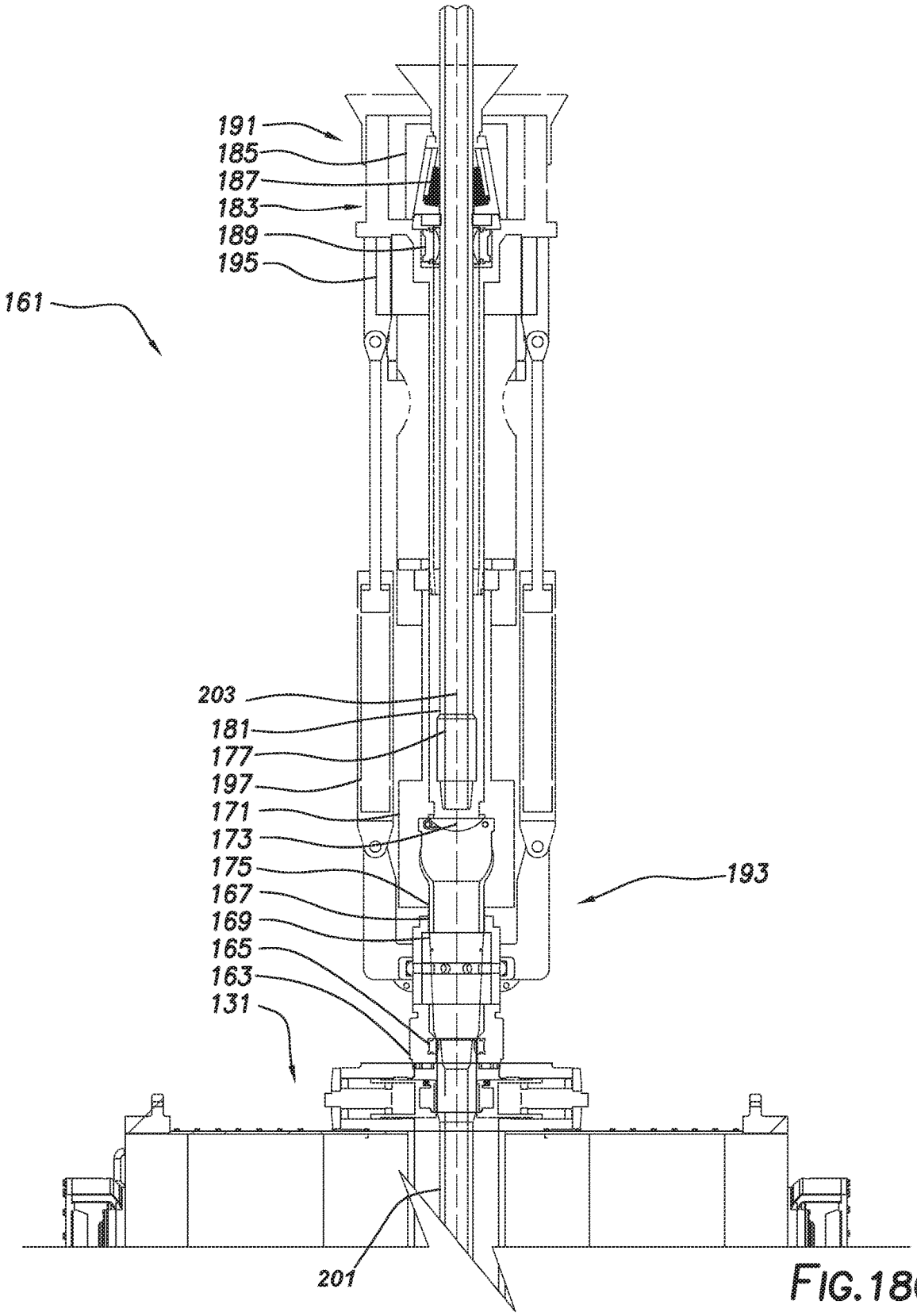

UDM 121 may move downward such that the lower end of next drill pipe 203 is stabbed into upper chamber 177 of CDU 161 as shown in FIGS. 18 and 18A. Inverted slips assembly 183 and upper seal 189 may be engaged against next drill pipe 203 as shown in FIG. 18B. The upper flow path through UMA 141 may be opened, introducing drilling fluid into upper chamber 177 of CDU 161 and equalizing the pressure within upper chamber 177 with the pressure within lower chamber 175 as shown in FIG. 18C.

Figure 19:
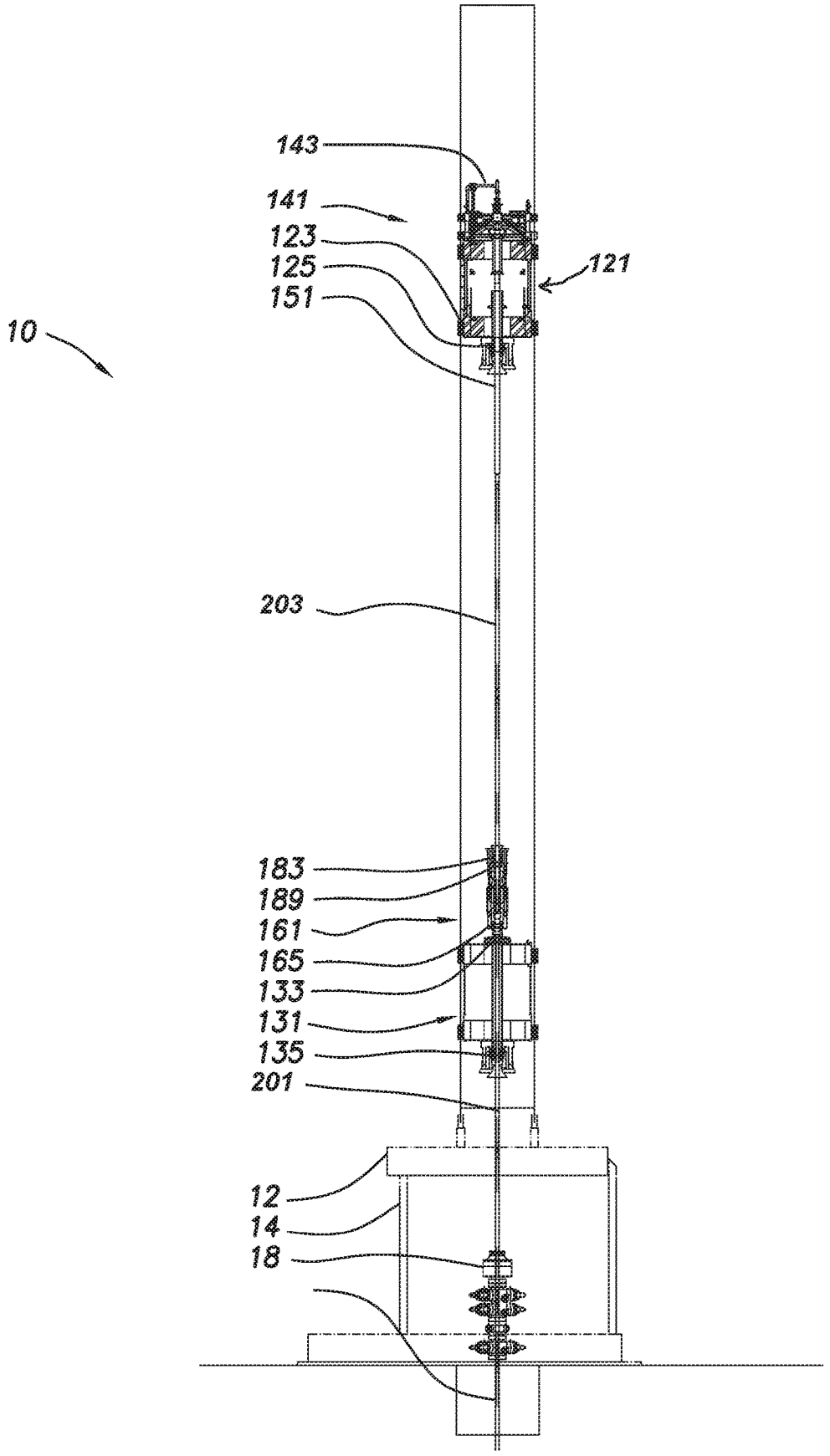
Figure 19A:
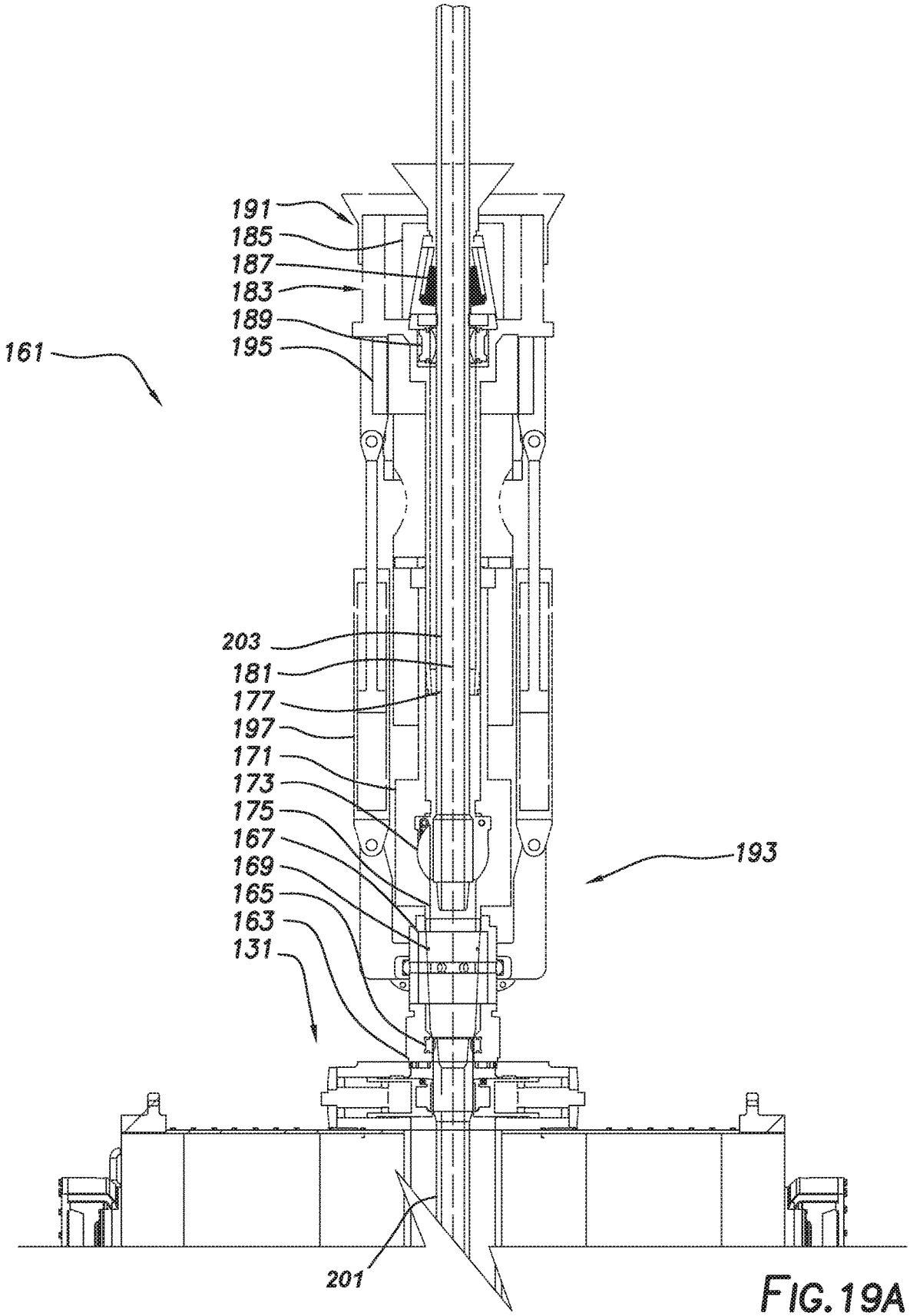

CDU 161 may then be partially retracted, extending the lower end of next drill pipe 203 into lower chamber 175 and opening valve 173 as shown in FIGS. 19 and 19A.

Figure 20:
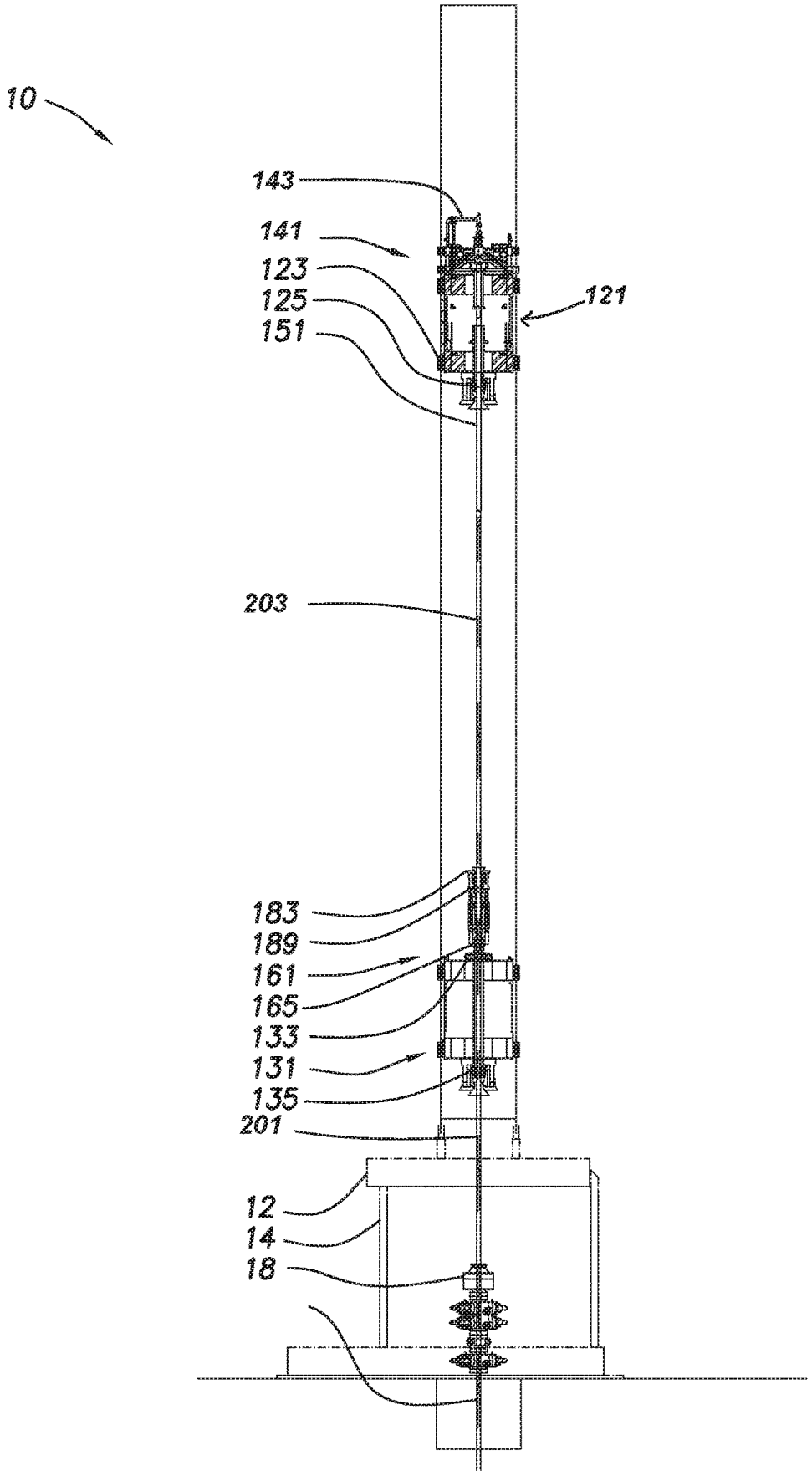
Figure 20A:
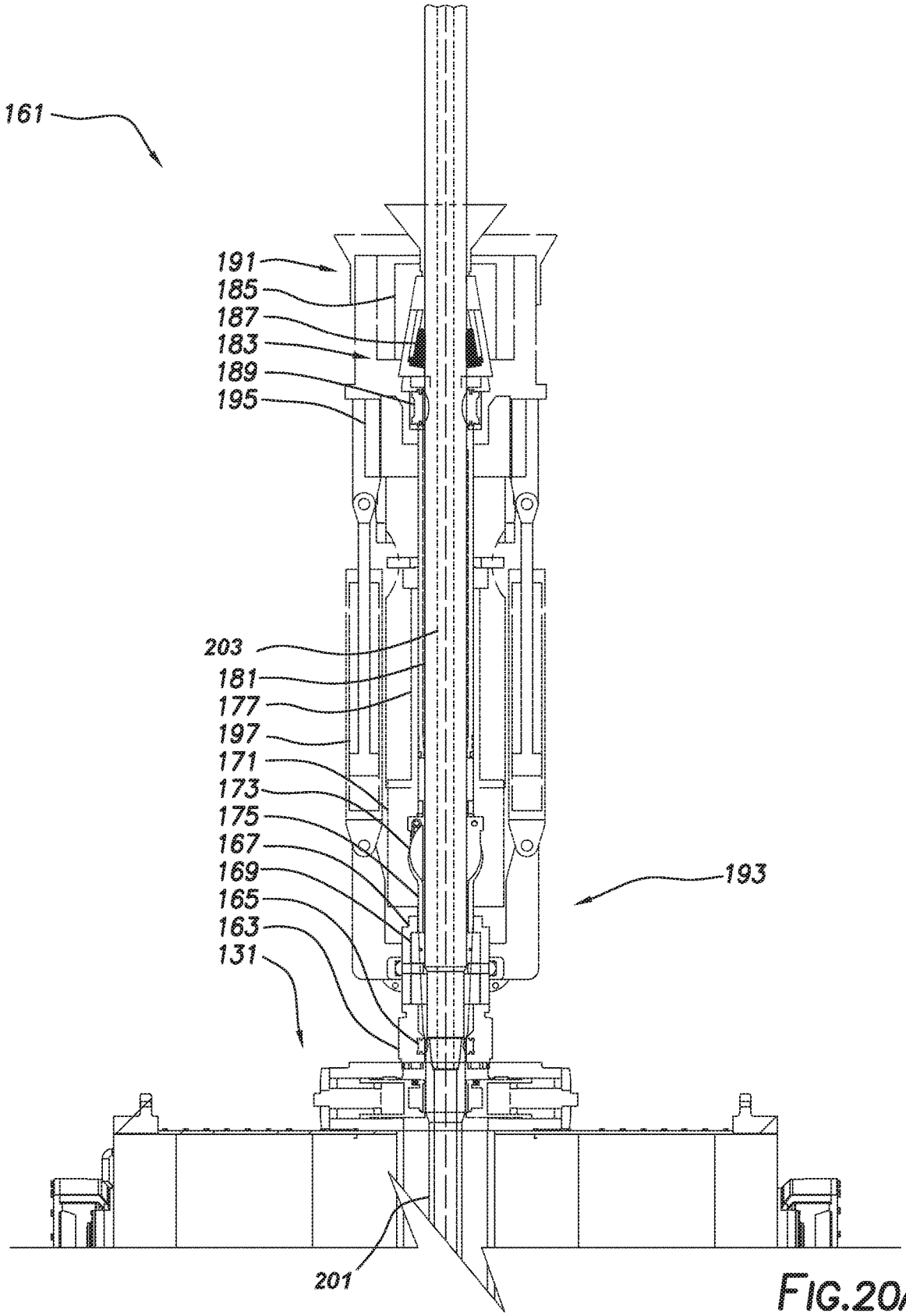
Figure 20B:
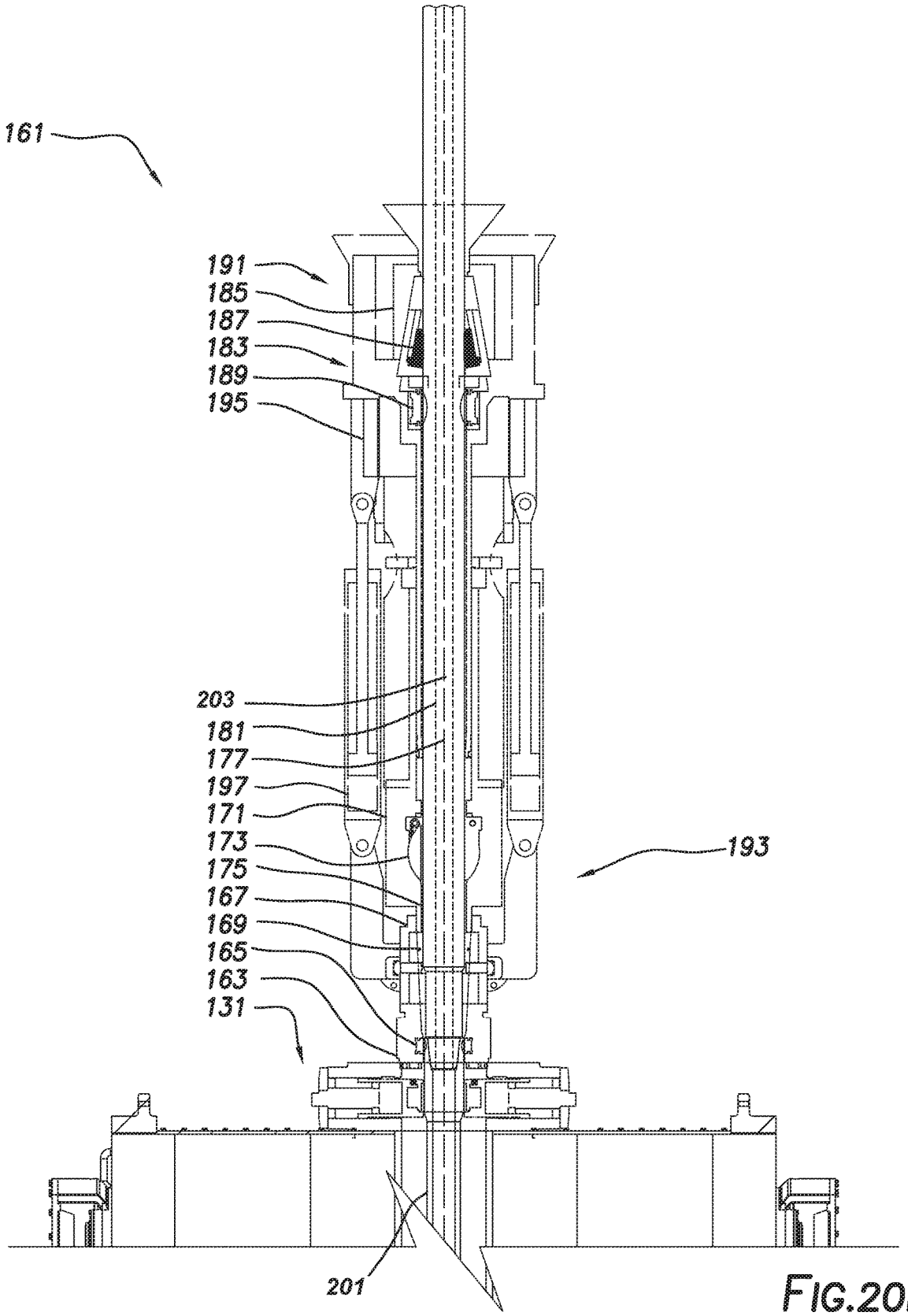
Figure 21:
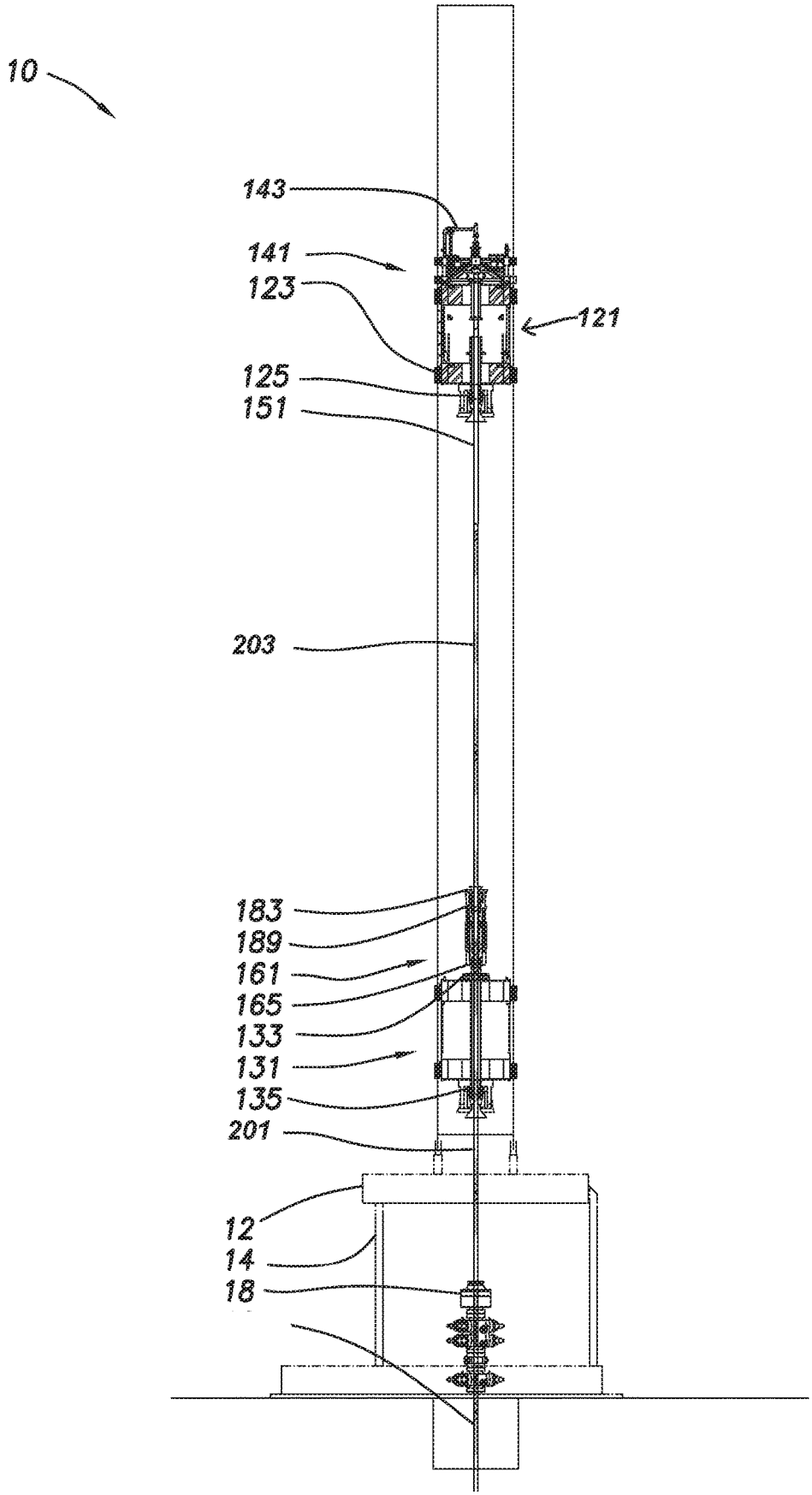
Figure 21A:
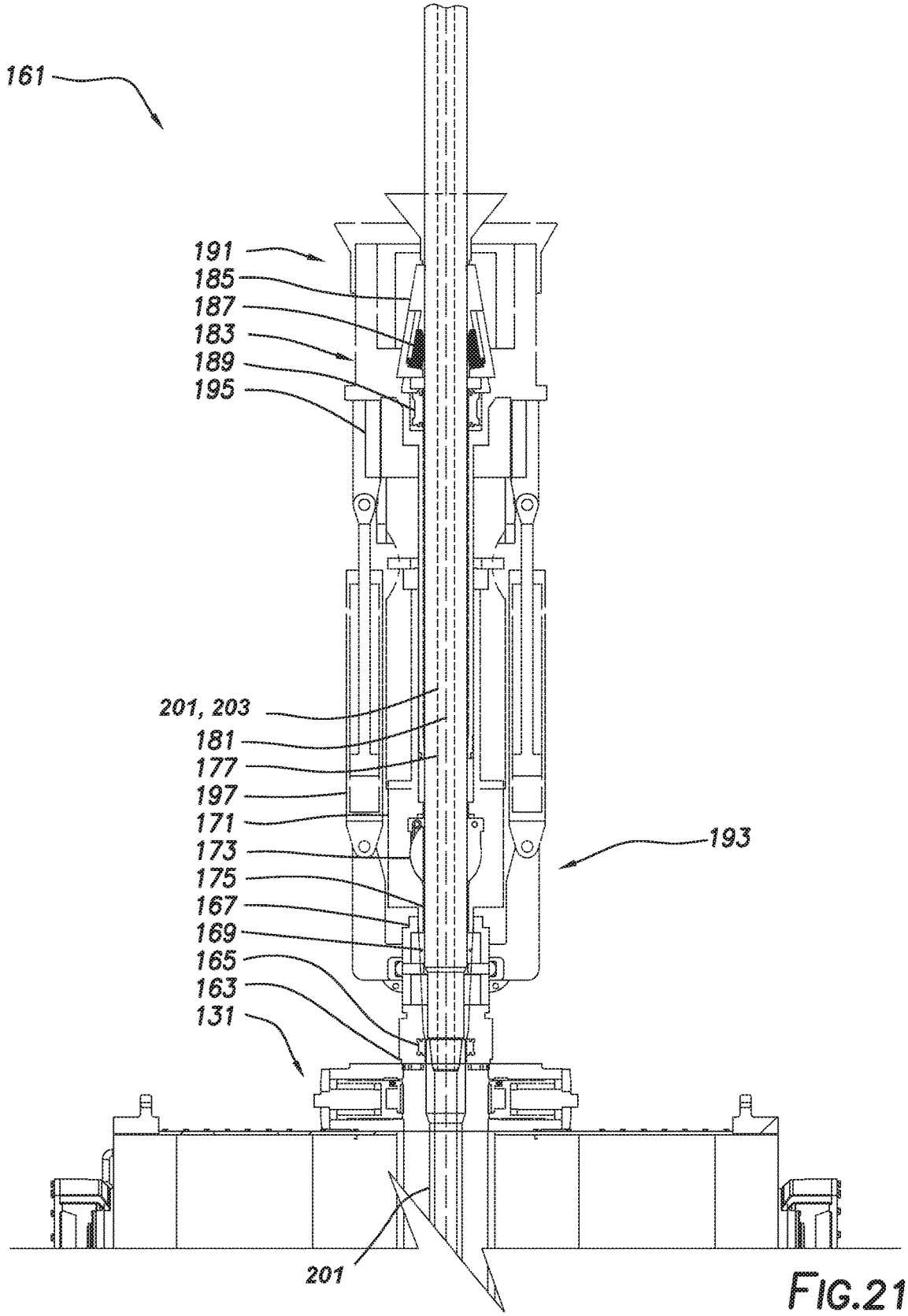

A threaded connection between next drill pipe 203 and drill string 201 may then be made-up. UDM 121 may rotate quill extension 151 and next drill pipe 203 at a speed higher than the drilling speed at which drill string 201 is rotated by LDM 131, defining a make-up speed. UDM 121 may lower and CDU 161 may be retracted as next drill pipe 203 is threadedly coupled to drill string 201 as shown in FIGS. 20 and 20A. Once the threaded connection is complete, UDM 121 may be slowed to rotate quill extension 151 and drill string 201—now including next drill pipe 203—at the drilling speed. The lower flow path through inlets 169 may be closed, and drilling fluid may be drained from upper chamber 177 and lower chamber 175 of CDU 161 as shown in FIG. 20B. The weight of drill string 201 may be transferred from LDM 131 to UDM 121 while both are engaged. UDM 121 and CDU 161 may then be disengaged from drill string 201 as shown in FIGS. 21 and 21A. Specifically, LDM clamps 133, LDM slips 135, lower seal 165, inverted slips assembly 183, and upper seal 189 may be disengaged from drill string 201. Rotation of LDM 131 may be halted. This operation may be repeated each time an additional drill pipe is to be added to drill string 201.

In some embodiments, a similar operation may be undertaken during trip-in or trip-out operations while maintaining continuous mud circulation or rotation of the drill string.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A drilling rig comprising:

a rig floor, the rig floor having a V-door, a side of the rig floor including the V-door defining a V-door side of the rig floor, the V-door having a V-door axis defined as perpendicular to the V-door side of the rig floor;

a first support structure and a second support structure, the rig floor supported by the first and second support structures, the rig floor, first support structure, and second support structure forming a trabeated structure, an open space between the first and second support structures and below the rig floor defining a traverse corridor having a traverse corridor axis, wherein the traverse corridor axis is perpendicular to the V-door axis;

a mast, the mast mechanically coupled to one or more of the rig floor, the first support structure, or the second support structure at one or more mast mounting points, the mast including a frame, the frame having an open side defining a mast V-door side, the mast V-door side aligned with the V-door, the mast including one or more racks coupled to the frame at the V-door side;

a lower drilling machine (LDM), the LDM coupled to and moveable vertically relative to the mast;

a continuous drilling unit (CDU), the CDU mechanically coupled to the LDM;

an upper drilling machine (UDM), the UDM coupled to and moveable vertically relative to the mast, wherein the UDM comprises:

UDM clamps, the UDM clamps adapted to engage a tubular member to allow the UDM to rotate the tubular member; and UDM slips, the UDM slips positioned to engage the tubular member to allow the UDM to move the tubular member vertically; and an upper mud assembly (UMA), the UMA coupled to and moveable vertically relative to the mast, the UMA including a drilling mud supply pipe adapted to supply drilling fluid to a tubular member gripped by the UDM defining an upper flow path.

2. The drilling rig of claim 1, further comprising a third support structure, the first, second, and third support structures defining a second traverse corridor axis.

3. The drilling rig of claim 1, wherein each of the first and second support structures comprises:

a lower box, the lower box in contact with the ground; and a support beam, the support beam pivotably coupled to the lower box at a lower pivot point and to the rig floor at an upper pivot point, the support beams forming linkages between the lower box and the rig floor to allow the rig floor to move between a lowered position and a raised position as the support beams pivot relative to the lower box and the rig floor.

4. The drilling rig of claim 3, wherein at least one of the first and second support structures further comprises a diagonal support beam extending between the lower box and the rig floor.

5. The drilling rig of claim 3, further comprising one or more hydraulic cylinders adapted to move the rig floor between the lowered position and the raised position.

6. The drilling rig of claim 1, further comprising a racking board coupled to the mast, the racking board including one or more fingerboards positioned to define slots in the racking board into which tubular members may be positioned for storage in a vertical position on the drilling rig.

7. The drilling rig of claim 6, wherein the fingerboards are arranged such that the slots extend radially from an open middle of the racking board such that tubular members may be positioned radially into the racking board relative to a position at the middle of the racking board.

8. The drilling rig of claim 6, further comprising a pipe handler assembly.

9. The drilling rig of claim 8, wherein the pipe handler assembly comprises:

a secondary mast, the secondary mast mechanically coupled to the rig floor;

a pipe handler, the pipe handler including a pipe gripper, the pipe gripper mechanically coupled to the secondary mast by a pipe handler arm and pipe handler carriage, the pipe handler arm mechanically coupled to the pipe handler carriage.

10. The drilling rig of claim 1, wherein the mast is pivotably coupled to the mast mounting points by a pinned connection.

11. The drilling rig of claim 10, wherein the mast is movable between a vertical position and a horizontal position.

12. The drilling rig of claim 1, wherein the mast is constructed from two or more mast subcomponents, the mast subcomponents decouplable from each other when the mast is in a horizontal position.

13. The drilling rig of claim 1, wherein the support structures comprise one or more walking actuators adapted to move the drilling rig through a wellsite along the transverse corridor axis.

14. The drilling rig of claim 13, wherein the walking actuators are rotatable, such that the walking actuators are adapted to move the drilling rig through the wellsite in multiple directions.

15. The drilling rig of claim 1, further comprising one or more of a mud tank, trip tank, process tank, mud process equipment, compressors, variable frequency drives, drill line spoolers, driller's cabin, choke house, mud gas separator skid, stair tower skid, hydraulic power unit skid, or accumulator skid is mechanically coupled to the rig floor or first or second support structures.

16. The drilling rig of claim 15, wherein a driller's cabin or choke house is positioned on or cantilevered from the rig floor.

17. The drilling rig of claim 15, wherein a mud gas separator skid and stair tower skid are mechanically coupled to the rig floor.

18. The drilling rig of claim 15, wherein a hydraulic power unit skid or accumulator skid is mechanically coupled to or cantilevered from the first or second support structures.

19. The drilling rig of claim 1, wherein the tubular member engaged by the UDM clamps and UDM slips are aligned with the racks of the mast.

20. The drilling rig of claim 1, wherein the LDM comprises:

LDM clamps, the LDM clamps adapted to engage a tubular member to allow the LDM to rotate the tubular member; and LDM slips, the LDM slips positioned to engage the tubular member to allow the LDM to move the tubular member vertically.

21. The drilling rig of claim 20, wherein the tubular member engaged by the LDM clamps and LDM slips is aligned with the racks of the mast.

22. The drilling rig of claim 1, wherein the CDU comprises:

a lower seal, the lower seal positioned within a lower seal housing, the lower seal positioned to seal against an upper end of a first tubular member gripped by the LDM;

a circulation housing, the circulation housing mechanically coupled to the lower seal housing, the circulation housing including one or more fluid inlets positioned to allow drilling fluid to enter the interior of the circulation housing and flow into the first tubular member, defining a lower flow path;

a valve, the valve positioned within a valve housing, the valve housing coupled to the circulation housing, the space within the lower seal housing, circulation housing, and valve housing between the lower seal and the valve defining a lower chamber;

an outer extension barrel mechanically coupled to the valve housing;

an inner extension barrel positioned within and adapted to slide telescopically within the outer extension barrel;

an upper seal mechanically coupled to the inner extension barrel, the upper seal positioned to seal against a lower end of a second tubular member, the space within the valve housing, outer extension barrel, and inner extension barrel between the valve and the upper seal defining an upper chamber;

an inverted slips assembly, the inverted slips assembly including a slips bowl and one or more wedges positioned to grip the second tubular member, the inverted slips assembly coupled to the inner extension barrel; and one or more linear actuators positioned to telescopically extend or retract the inverted slips assembly and upper seal vertically relative to the valve housing.

23. A method comprising:

positioning a drilling rig at a wellsite, the drilling rig including:

a rig floor, the rig floor having a V-door, the side of the rig floor including the V-door defining a V-door side of the rig floor, the V-door having a V-door axis defined as perpendicular to the V-door side of the rig floor;

a first support structure and a second support structure, the rig floor supported by the first and second support structures, the rig floor, first support structure, and second support structure forming a trabeated structure, an open space between the first and second support structures and below the rig floor defining a traverse corridor having a traverse corridor axis, wherein the traverse corridor axis is perpendicular to the V-door axis;

a mast, the mast mechanically coupled to one or more of the rig floor, the first support structure, or the second support structure at one or more mast mounting points, the mast including a frame, the frame having an open side defining a mast V-door side, the mast V-door side aligned with the V-door, the mast including one or more racks coupled to the frame at the V-door side;

a lower drilling machine (LDM), the LDM coupled to and moveable vertically relative to the mast;

a continuous drilling unit (CDU), the CDU mechanically coupled to the LDM;

an upper drilling machine (UDM), the UDM coupled to and moveable vertically relative to the mast; and an upper mud assembly (UMA), the UMA coupled to and moveable vertically relative to the mast, the UMA including a drilling mud supply pipe adapted to supply drilling fluid to a tubular member gripped by the UDM defining an upper flow path; and continuously drilling a wellbore using the drilling rig, wherein, the UDM comprises:

UDM clamps, the UDM clamps adapted to engage a tubular member to allow the UDM to rotate the tubular member; and UDM slips, the UDM slips positioned to engage the tubular member to allow the UDM to move the tubular member vertically;

the LDM comprises:

LDM clamps, the LDM clamps adapted to engage a tubular member to allow the LDM to rotate the tubular member; and LDM slips, the LDM slips positioned to engage the tubular member to allow the LDM to move the tubular member vertically; and the CDU comprises:

a lower seal, the lower seal positioned within a lower seal housing, the lower seal positioned to seal against an upper end of a first tubular member gripped by the LDM;

a circulation housing, the circulation housing mechanically coupled to the lower seal housing, the circulation housing including one or more fluid inlets positioned to allow drilling fluid to enter the interior of the circulation housing and flow into the first tubular member, defining a lower flow path;

a valve, the valve positioned within a valve housing, the valve housing coupled to the circulation housing, the space within the lower seal housing, circulation housing, and valve housing between the lower seal and the valve defining a lower chamber;

an outer extension barrel mechanically coupled to the valve housing;

an inner extension barrel positioned within and adapted to slide telescopically within the outer extension barrel;

an upper seal mechanically coupled to the inner extension barrel, the upper seal positioned to seal against a lower end of a second tubular member, the space within the valve housing, outer extension barrel, and inner extension barrel between the valve and the upper seal defining an upper chamber;

an inverted slips assembly, the inverted slips assembly including a slips bowl and one or more wedges positioned to grip the second tubular member, the inverted slips assembly coupled to the inner extension barrel; and one or more linear actuators positioned to telescopically extend or retract the inverted slips assembly and upper seal vertically relative to the valve housing.

24. The method of claim 23, wherein continuously drilling comprises:

engaging the first tubular member with the LDM clamps, LDM slips, and lower seal;

rotating the first tubular member with the LDM at a first speed, defined as a drilling speed;

closing the valve;

flowing drilling fluid into the first tubular member through the lower flow path;

extending the inverted slips assembly and upper seal vertically with the linear actuators;

engaging the second tubular member with the UDM clamps and UDM slips;

lowering the second tubular member into the CDU;

engaging the second tubular member with the inverted slips and upper seal;

rotating the second tubular member with the UDM at a higher speed than the drilling speed;

flowing fluid through the second tubular member through the upper flow path;

retracting the inverted slips assembly and upper seal with the linear actuators;

opening the valve;

threadedly coupling the first and second tubular members;

rotating the first and second tubular members at the drilling speed with the UDM;

disengaging the LDM clamps, LDM slips, lower seal, inverted slips, and upper seal;

moving the LDM vertically upward such that the LDM clamps are aligned with the top of the second tubular member;

engaging the LDM clamps, LDM slips, and lower seal to the second tubular member;

rotating the second tubular member with the LDM;

disengaging the second tubular member from the UDM; and flowing drilling fluid through the second tubular member through the lower fluid path.

25. The method of claim 24, wherein the second tubular member is engaged to the UDM through a quill extension, the quill extension threadedly coupled to an upper end of the second tubular member.

26. The method of claim 25, wherein disengaging the second tubular member from the UDM comprises:

engaging the quill extension with the inverted slips and the upper seal;

rotating the quill extension with the UDM at a slower speed than the drilling speed;

threadedly disengaging the quill extension from the second tubular member;

extending the inverted slips assembly and upper seal vertically with the linear actuators;

closing the valve; and disengaging the quill extension with the inverted slips and the upper seal.

* * * * *